US008850677B2

(12) United States Patent
LeMieux

(10) Patent No.: US 8,850,677 B2
(45) Date of Patent: Oct. 7, 2014

(54) RIVET SETTING SYSTEM

(71) Applicant: David L. LeMieux, Clancy, MT (US)

(72) Inventor: David L. LeMieux, Clancy, MT (US)

( * ) Notice: Subject to any disclaimer, the term of this patent is extended or adjusted under 35 U.S.C. 154(b) by 0 days.

(21) Appl. No.: 13/694,331

(22) Filed: Nov. 20, 2012

(65) Prior Publication Data

US 2013/0081242 A1 Apr. 4, 2013

Related U.S. Application Data

(62) Division of application No. 12/384,392, filed on Apr. 1, 2009, now Pat. No. 8,316,524.

(51) Int. Cl.

| | |
|---|---|
| ***B21J 15/10*** | (2006.01) |
| ***B21J 15/02*** | (2006.01) |
| ***B21J 15/36*** | (2006.01) |
| ***B21J 15/28*** | (2006.01) |

(52) U.S. Cl.

CPC *B21J 15/10* (2013.01); *B21J 15/02* (2013.01); *B21J 15/105* (2013.01); *B21J 15/36* (2013.01); *B21J 15/28* (2013.01)

USPC ..... 29/243.53

(58) Field of Classification Search

USPC ..... 29/524.1, 243.53, 716, 509, 243.525, 29/243.54, 525.06, 34 B, 33 K, 281.5, 29/897.2, 714, 464, 466, 715; 227/52, 2, 227/27.7; 72/466.5

See application file for complete search history.

(56) References Cited

U.S. PATENT DOCUMENTS

| | | | | |
|---|---|---|---|---|
| 1,803,965 | A | | 5/1932 | Evans, Sr. |
| 2,354,914 | A | | 8/1944 | Goldstein |
| 3,034,641 | A | * | 5/1962 | Kochan ..... 29/566 |
| 3,478,567 | A | | 11/1969 | Galutia |
| 3,559,269 | A | | 2/1971 | Schmitt et al. |
| 3,574,918 | A | | 4/1971 | Focht |
| 3,933,025 | A | | 1/1976 | Briles |
| 4,046,039 | A | | 9/1977 | Griesbach |
| 4,130,006 | A | | 12/1978 | Ebbert |
| 4,218,911 | A | | 8/1980 | Johnston |
| 4,566,182 | A | | 1/1986 | Altwicker et al. |
| 5,398,537 | A | | 3/1995 | Michalewski et al. |
| 5,953,952 | A | | 9/1999 | Strickland |
| 6,011,482 | A | | 1/2000 | Banks et al. |
| 6,073,326 | A | | 6/2000 | Banks |
| 6,088,897 | A | | 7/2000 | Banks et al. |
| 6,357,101 | B1 | | 3/2002 | Sarh et al. |
| 6,363,768 | B1 | | 4/2002 | Earls et al. |
| 6,823,709 | B2 | | 11/2004 | Dowell |
| 7,266,876 | B2 | | 9/2007 | Thompson |
| 7,331,205 | B2 | | 2/2008 | Chitty et al. |
| 7,559,133 | B2 | | 7/2009 | Chitty |
| 7,596,858 | B2 | | 10/2009 | Opper |
| 7,832,074 | B2 | | 11/2010 | Stevenson |

OTHER PUBLICATIONS

International Search Report mailed Mar. 27, 2013, issued in corresponding International Application No. PCT/US12/00561, filed Nov. 26, 2012, 33 pages.

* cited by examiner

*Primary Examiner* — John C Hong
(74) *Attorney, Agent, or Firm* — Christensen O'Connor Johnson Kindness PLLC

(57) ABSTRACT

A system and method for rivet setting comprising a micro-adjustable bucking bar coupled to a control system that measures the rivet head during the rivet setting process and stops the rivet gun when the rivet head achieves a desired head height above the work surface. In preferred embodiments, the control system also communicates the stage of the rivet driving cycle to the operators to expedite the rivet driving process.

21 Claims, 22 Drawing Sheets

RIVET SETTING SYSTEM

CROSS-REFERENCE TO RELATED APPLICATIONS

This is a divisional application of U.S. patent application Ser. No. 12/384,392, filed on Apr. 1, 2009; the disclosure of which patent application is incorporated by reference as if fully set forth herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

This invention relates to a system and method for fastening rivets and/or using process indicators to communicate to operators the stage of each rivet during a rivet setting cycle. In particular, the invention relates to a system and method that relies on a micro-adjustable switching mechanism that is used as part of a feedback control system to achieve rivet setting tolerances by measuring in real-time or near-real-time the rivet's driven head (sometimes called the upset head or shop head) height while the control system also controls rivet gun operation and communicates the rivet driving-cycle stage to the rivet setting operator(s).

Riveting produces the strongest practical means of fastening airplane skins and substructure together. Although the cost of installing one rivet is small, installing the great number of rivets used in airplane manufacture represents a large percentage of the total cost of any airplane.

It should be first noted that the term "tolerance" is used broadly throughout this disclosure. Conventionally, the term tolerance signifies a plus or minus range of acceptance on a bell-shaped-curve distribution of samples with preferably the peak of the bell-shaped curve representing the optimum bounded by narrow bandwidth indicating very small standard deviations. The curve is used to quantitatively characterize defects. In this disclosure, the term tolerance also sometimes refers to a specific value representing the optimum peak of the bell-curve (or very near peak, i.e., extremely tight tolerance). For example, "It is often difficult to consistently set rivets to meet tolerances but it is extremely difficult to consistently set rivets to an optimal tolerance."

Although this invention may be applied to special types of rivets, for purposes of clarity, this disclosure uses as an example conventional solid-shank rivets that comprise a manufactured head, a shank and a driven head. The driven head is formed by upsetting the rivet shank with a rivet gun while backing the shank with a bucking bar. The shank actually expands slightly while being driven so the rivet fits tightly in the drilled hole.

Where there is easy access to both sides of the work, the rivet-gun operator can sometimes simultaneously drive the rivet and back the rivet with a bucking bar; however in most cases both a rivet-gun operator and a bucking-bar operator or bucker must work together to drive solid-shank rivets. The conventional procedure for driving rivets is as follows: (1) the rivet gun operator adjusts the air regulator which controls the pressure or hitting force of the pneumatic rivet gun; next (2) the rivet gun operator inserts the rivet into the drilled hole, places the rivet set tool face against the rivet and waits for the bucker; next (3) the bucker holds the bucking bar on the protruding shank-end of the rivet; next (4) the rivet gun operator should "feel" the pressure being applied by the bucker through the rivet; and finally (5) the rivet-gun operator will start the rivet gun by pulling the trigger to release a short burst of rivet-gun blows and then stop the rivet gun when the rivet has been driven or set to be within a desired range of manufacturing specifications or tolerances.

Throughout the rivet setting process, both operators must hold their tools perpendicular or orthogonal to the work so the rivet is driven axially. The entire rivet setting process requires both skill and experience since the rivet-gun operator must determine rivet gun burst-length or blows needed according to variables such as bucking resistance being applied, the rivet size being driven, the rivet gun pressure setting and the mass of the rivet gun and bucking bars. These variables must be judged by the rivet-gun operator to time the length of the rivet driving stage needed to achieve rivet setting tolerances.

Further, to communicate with each other, the rivet-gun operator and bucker conventionally use a tapping code to enable to bucker to communicate with the rivet-gun operator: one-tap on the rivet by the bucker means start or resume driving the rivet (resuming is often necessary when the rivet has been under-driven and has not reached tolerance); two-taps on the rivet by the bucker means the finished or set rivet was within satisfactory tolerance; three-taps on the rivet by the bucker means the rivet was improperly set and must be removed (this typically occurs when the rivet has been over-driven and can not be modified to achieve tolerance). Where verbal communication is possible, the rivet-gun operator typically announces "ready" when he is ready to begin riveting and waits for the bucker to likewise announce "ready" when he is ready to begin bucking and follows with a "good", "drive more" or "not good" verbal report of the completed set rivet.

To achieve design strength, the driven head of a rivet must fall within an acceptable tolerance range; to inspect rivets, the bucker sometimes uses a gauge to measure the driven head-height or driven head-width after the rivet has been set. Often, however, to save time, the bucker only visually inspects the driven head to determine if it meets required tolerances. If the rivet has been under-driven leaving the head height too high, additional driving is needed (although due to work hardening of the rivet material, rivet holding strength for rivets driven in repeated driving stages is often reduced). Over-driven rivets require removal, which is a time consuming process that can often damage the work and sometimes requires using an oversized replacement rivet having a different setting tolerance. Over-driven rivets often blemish or bend the work, sometimes causing costly rework or irreparable damage.

The background art is characterized by U.S. Pat. Nos. 1,803,965; 2,354,914; 3,478,567; 3,559,269; 3,574,918; 3,933,025; 4,218,911; 4,566,182; 5,398,537; 5,953,952; 6,011,482; 6,088,897; 6,357,101; 6,363,768; 6,823,709; and 7,331,205; the disclosures of which patents are incorporated by reference as if fully set forth herein.

Although the conventional method of driving rivets described above has been effective for many years, there are some inventions that attempt to improve the process. As an example, U.S. Pat. No. 5,953,952 by Strickland proposes a micro-adjustable bucking bar anvil to set the distance between the anvil face and the spindle's feet base to match desired driven head height of a set rivet. Strickland further proposes that the spindle's feet help the bucker maintain axial alignment of the tool relative to the rivet shank and orthogonal alignment of the bucking tool relative to the work surface. Finally, Strickland proposes use of a compression spring working between the bucking tool and the work to hold the work sheathing pieces together while riveting.

In another example, U.S. Pat. No. 6,363,768 by Earls and Bland simplifies the Strickland design by proposing a precision bucking bar having a recessed anvil face with the equivalent of non-adjustable spindle's feet formed by their nearest reference as "sidewalls." This invention requires that the bucker choose a bucking bar having "sidewalls" the same height as the desired driven head of the set rivet.

In both examples above, however, the bucker must visually identify when the driven head is finished (identified when the spindle's feet or equivalent make contact with the work) and then the bucker must immediately signal the rivet-gun operator to stop the rivet gun. This communication from the bucker to the rivet gun operator to "stop riveting" is difficult to achieve because no adequate means to affect this communication, during the loud riveting process, is proposed. Furthermore, due to reaction times of both operators and the fact that a rivet gun typically hammers at rates exceeding 20 Hertz, it is unlikely that these methods could achieve consistent desired rivet setting tolerance control. Most importantly, if the rivet gun were not immediately stopped at the moment the bucker visually identified rivet set completion, the additional impacting forces from the rivet gun would be imparted through the rivet to the anvil face and from the set-rivet through the work to the spindle's feet resulting in the spindle's feet causing damage to the work. Damage to the work could include bending, marring, crushing and/or scratching. In addition to reduced strength from airframe damage or substructure damage, damage to the anodized work surfaces could also result in premature corrosion. It is important to note in both these inventions that rivet head achieves the desired set tolerance only when the spindle's feet touch the work and that this contact requires visual identification by the bucker. Due to the vibratory nature of riveting, this would be difficult to reliably observe. Furthermore, since the spindle's feet do not rest against the work until the rivet is set, the spindle's feet are a poor tool alignment aid.

In yet another example, U.S. Pat. No. 6,011,482 by Banks et al. requires massive rail-mounted riveting equipment operating on each side of the work components being fastened together; the equipment requires costly computer numerically controlled (CNC) position control machines and extensive capital costs for the rivet driving machinery. The reference states near line 60 that the manual "process results in rivets that were unevenly deformed, poorly seated" and near line 65 that "unfortunately, the manual process is dangerous, time consuming, expensive and often leads to extensive rework." Also, the Banks invention only "determines the acceptability of the rivet within a component" and does not control the rivet driving process to achieve an optimal set of a driven rivet head. In another example, U.S. Pat. No. 6,357,101 by Sarh et al. similarly requires massive rail mounted riveting equipment that is beyond the scope of most common manual rivet installation applications.

In another example, in U.S. Pat. No. 7,331,205 by Chitty et al., a rivet gun technique is proposed that measures set tool strain and rivet gun pressure in a rivet gun to set blind rivets. In other words, continuous analog sensor measurement of a hydraulic rivet gun pressures are used to access the driven head throughout its forming process; this assessment is coupled with controlling rivet gun impact force and measuring driving time are used to directly control set rivet material strength and thus control rivet holding strength. While the Chitty et al. invention is used for setting blind rivets, the reference does not teach use of measured deflections of the rivet head over time and assessment of the number of impacts needed to determine optimal rivet gun pressure settings while also still maintaining settings within ranges acceptable for manual operation.

None of the references teach or suggest the invention disclosed herein. What is needed is a rivet fastener system that overcomes the disadvantages of the background art. To overcome the disadvantages of the background art, a rivet fastening system is disclosed herein.

BRIEF SUMMARY OF THE INVENTION

The purpose of the invention is to provide means and methods for fastening rivets and/or using process indicators to communicate to operators the driving stage of each rivet during a rivet setting cycle.

One object of preferred embodiments of the invention is to measure the formed rivet head during the rivet driving process and through a feedback control process disable or stop the rivet gun the moment the rivet head achieves the desired set tolerance. In this embodiment, an automated control process allows both operators to focus on holding their tools orthogonal to the work surface and not be concerned about under-driving or over-driving the rivet. Another object of preferred embodiments of the invention is to provide a means for communicating the stage of the rivet driving process to both rivet-gun and bucking operators by means of light, e.g., light-emitting diode (LED) indicators, with at least one LED located on or near the bucking bar and at least one LED located on or near the rivet gun. By detecting the switch states of one or more switches, the control system operates the LED indicator lights to sequentially signal the operators and thus guide them though each sequential stage of the rivet setting cycle.

It is yet another object of preferred embodiments of the invention to prevent inadvertent damage to the airframe by using a control system to disable the rivet gun when not needed and enable the rivet gun only when both the rivet-gun operator and bucker have signaled (by LED lights via a microprocessor detecting switch states) that they are ready for the rivet driving stage of a rivet setting cycle.

It is yet another object of preferred embodiments of the invention to use a unique micro-adjustable bucking bar that can be adjusted to toggle a switch state during the rivet driving stage when the height of a rivet's driven head achieves an optimal rivet set tolerance; this switching action then disables the rivet gun and stops the riveting process. In this embodiment, preferably an electromechanical switch and/or an optical photointerrupter switch is used to detect a rivet set threshold. However other means of measuring the formed rivet head height during the rivet driving stage are envisioned by the applicant. For example, in an alternate embodiment, during the rivet's driving-stage, continuous analog measurement of the rivet head height above the work surface may be achieved with a Linear Variable Differential Transducer (LVDT) sensor. In this embodiment, a LVDT sensor continuously measures the formed rivet head height by likewise directly or indirectly measuring the gap or distance between the bucking anvil face and the work to determine the rivet-head-height of the driven rivet head. Embodiments comprising non-contact sensors are also envisioned and may include at least one inductive and/or capacitive technologies.

It is yet another object of preferred embodiments of the invention to perform data logging in computer memory of the measured rivet driven head height after the rivet has been set for Quality Assurance and Quality Control verification purposes. It is yet another object of preferred embodiments of the invention to use a proposed plunger mechanism on the bucking bar to press pieces of joined work pieces together by applying compression spring force to the work surface during the rivet setting process. Additionally, the plunger mechanism in this preferred embodiment of this invention also forms a shroud around the rivet head and thus serves to prevent the bucking tool from sliding off the formed rivet head during the rivet driving stage. This reduces the opportunity of the rivet gun hammering on a rivet this is not backed by a bucking bar and thus causing damage to the airframe or substructure work. Furthermore, the plunger mechanism also helps the bucker maintain orthogonal alignment of the bucking tool relative to the work by holding the spindles feet of the plunger flush against the work during the rivet driving cycle.

It is still another object of preferred embodiments of the invention to log at least one of the quality of set rivets, the rivets setting performance of operators, the time to complete specific riveting projects and the projected time to complete specific riveting jobs.

While as previously stated preferred embodiments of the invention eliminate under-driving the rivet and consequently prevents a plurality of hammering sessions; it is yet another object of preferred embodiments of the invention to maximize set rivet material strength. During the rivet driving stage, the rivet shank undergoes plastic deformation; the shank-end becomes the driven head and forms into a mushroom shape and the shank also simultaneously expands. If the gun force is set too low, then excessive rivet gun blows or impacts are required to set the rivet; this causes the rivet material to fatigue or work harden resulting in reduced material strength of the rivet and therefore reduced rivet holding strength. Ideally, rivets should be set with a minimum number of impacts but excessive rivet gun force is difficult for operators to control while simultaneously maintaining tool alignment orthogonal to the work surface. In this embodiment, therefore, the control system measures the number of impacts and the driving stage time to determine if the rivet gun impact force should be increased or decreased while also keeping the impacting force within acceptable operator-tool-control limits. The rivet setting time interval measurement begins when the rivet driving stage starts and ends when the driven head achieves optimum tolerance (when a measuring threshold has been reached). The number of impacts is preferably measured by counting the small moments in time when the bucking bar is bucked off the end of the shank immediately after receiving an impact force from the rivet gun through the rivet shank; as detected by a momentary break or switching in a circuit by a microcontroller or computer. Alternately an accelerometer or other impact detecting sensor attached to the rivet gun or bucking bar could is used to count the number of rivet-driving-stage impacts. The control system then indicates to the operator to increase or decrease the impact force or alternately automatically makes this adjustment by controlling the air pressure regulator setting for the rivet gun. Any type of communication such as LEDs, LED light bars or liquid crystal displays (LCDs) may be used to notify the rivet gun operator of recommended air-pressure regulator setting changes.

In an alternate embodiment of the invention, the operator provides computer inputs such as the rivet size being driven and the total joined sheathing material thickness into the controller's memory via any type of input device such as a keypad. This allows the controller to determine the optimal number of impacts needed for the job in order to produce the highest strength rivets and also determines the optimal tolerance threshold for the formed rivet head height 84 (where analogue sensors are employed). Those skilled in the art will appreciate that a control approach disclosed herein, coupled with real-time or near-real-time measurement of the upsetting rivet head, may also be used to set solid shank rivets at a specified location on a stress-strain curve to maximize rivet fastener strength and durability. Furthermore, with accurate and precise measurement systems coupled to real-time feedback control incorporated into the invention, achieving "ideal" or very low standard deviations (at, near or better than "six sigma") for any desired rivet set objective is possible.

In a preferred embodiment, the invention comprises electronic circuits, a computer, software code, switches, a specialized bucking bar and lights (such as LEDs) to provide means of communication between the rivet gun operator and the bucker and additionally to provide feedback control of the rivet gun operation. In this embodiment, several switches and LEDs are used to identify and communicate the stage of the riveting cycle to the operators as well as to enable the rivet gun; another switch detects when a rivet has been set to a specific height and width and ends the riveting cycle by disabling the rivet gun. A computer operating in accordance with software disclosed herein preferably reads switch states and controls the rivet setting process by sequencing the rivet driving process (communicating the sequenced rivet driving stage to operators) by status LED lights indicators and enabling and disenabling the rivet gun. The circuit preferably includes a multi-conductor cable that extends from a circuit board located near the rivet gun to the bucking bar system and serves to service communication and control; although, in an alternate embodiment, this cable is replaced with radio frequency (RF) signals. The bucking bar system preferably has a micro-adjustable gap-height setting that the operator sets to match the desired driven head height of a rivet; when this dimension is achieved during the rivet driving process, a switch is made which ends the cycle by electro-mechanically disabling the rivet gun. The rivet gun is enabled and disabled by electromechanical means including at least one of the following: an air solenoid controlling air power to the rivet gun or electromechanical control of gun operation.

In a preferred embodiment, the invention is a method for setting a rivet in a work piece, said rivet having a rivet manufactured head and a shank having a shank end, said method comprising: sensing when a rivet set tool of a rivet gun has been placed on the rivet manufactured head and indicating to a bucking bar operator that a rivet gun operator is ready to commence riveting; sensing when a bucking bar has been placed on the shank end and indicating to said rivet gun operator that said bucking bar operator is ready to commence riveting; driving the rivet by forcing the shank against said bucking bar with said rivet set tool to form a driven rivet head; sensing when the height of said driven rivet head is substantially equal to a desired set rivet head height and indicating to both said bucking bar operator and said rivet gun operator that said desired set rivet head height has been achieved; and ceasing driving the rivet when said driven rivet height is substantially equal to said desired set rivet head height. Preferably, said rivet gun is a pneumatic rivet gun the operation of which is controlled by a solenoid valve, said method further comprising: first actuating said solenoid valve when said driven rivet head height is substantially equal to said desired set rivet head height to operatively decouple said rivet gun from an air supply source and stop riveting; and second actuating said solenoid valve to operatively couple said rivet gun to said air supply source when said rivet gun operator and said bucking bar operator are both ready to start riveting. Preferably, said rivet gun is a pneumatic rivet gun the operation of which is controlled by a (e.g., normally open) solenoid valve, and said method further comprises: closing said solenoid valve when said driven rivet head height is substantially equal to said desired set rivet head height. A person having ordinary skill in the art would understand that a normally closed solenoid valve could be used instead.

In another preferred embodiment, the invention is a system for setting a rivet in a work piece, said rivet having a rivet manufactured head and a shank having a shank end, said system comprising: means for sensing when a rivet set tool has been placed on the rivet manufactured head and indicating to a bucking bar operator that a rivet gun operator is ready to commence riveting; means for sensing when a bucking bar has been placed on said shank end and indicating to said rivet gun operator that said bucking bar operator is ready to commence riveting; means for driving the rivet by forcing the shank against said bucking bar with said rivet set tool to form a driven rivet head; means for sensing when the height of said driven rivet head is substantially equal to a desired set rivet head height and indicating to both said bucking bar operator and said rivet gun operator that said desired set rivet head height has been achieved; and means for ceasing driving the rivet when said driven rivet height is substantially equal to said desired set rivet head height. Preferably, said means for driving is a pneumatic rivet gun that is controlled by a solenoid valve, and said system further comprises: means for closing said solenoid valve when said driven rivet head height is substantially equal to said desired set rivet head height.

In yet another preferred embodiment, the invention is a bucking bar for forming a rivet head, said bucking bar comprising: a housing having a cap and a cavity into which a cylinder stem protrudes, said cylinder stem having a distal shoulder; a plunger that is slidably mounted in said cavity, said plunger comprising a plunger stem that is mounted on said cylinder stem, said plunger stem having a plunger shoulder and a proximal shoulder; a compression spring that is disposed within said plunger stem and that has a first end that rests on said distal shoulder and a second end that rests on said proximal shoulder; a hammer that is slidably mounted in said plunger, said hammer having an anvil face at one end and being immovably attached to said housing at another end. Preferably, the bucking bar further comprises: a traveling nut that is disposed within said cavity and around said plunger stem, said traveling nut being held in position relative to said anvil face by a micro-adjustable jackscrew assembly; and a switch that is attached to said traveling nut and that is operative to change its state (e.g., to open or to close) when the position of said plunger shoulder relative to said switch indicates that a desired set rivet head height has been achieved. Preferably, the bucking bar further comprises: a wire that connects said switch to and between a power supply and means for detecting when said desired set rivet head height has been achieved. Preferably, the bucking bar further comprises: a conducting post that is attached to said cap and disposed in said cavity and that passes through said traveling nut, said conducting post being in electrical communication with said anvil face; a bucking bar indicator light that is attached to the exterior of said housing; a first wire that connects said conducting post to means for detecting when said anvil face is in contact with the rivet shank; and a second wire that connects said bucking bar indicator light to a ground; wherein said bucking bar indicator light is operative to become illuminated when said rivet gun operator and said bucking bar operator are both ready to commence riveting. Preferably, said plunger further comprises a shroud that surrounds said rivet head when said bucking bar is in use. In a preferred embodiment, the shroud's being bucked off because the anvil face gets bucked far away from the forming rivet head is correctable by having the shroud extend farther past the anvil face and requiring more compressive force to be applied to the plunger for the bucker to indicate that he is ready. Preferably, said plunger further comprises a spindles feet that extends through said hammer and beyond said anvil face.

In a further preferred embodiment, the invention is a system for setting a rivet in a work piece, said rivet having a rivet manufactured head and a shank, said rivet being in conductive communication with said work piece, said system comprising: a circuit subassembly having a first source of power and a bucker ready indicator light, said circuit subassembly being in conductive communication with said work piece; a rivet gun that is equipped with a rivet set tool, said rivet tool being in conductive communication with said circuit subassembly and having a second source of power; and a bucking bar system, said bucking bar system having a rivet gun operator ready indicator light that is in conductive communication with said circuit subassembly; wherein said rivet set tool is operative to impose a first voltage on said rivet manufactured head when it is placed in contact with said rivet manufactured head. Preferably, the system further comprises: a switch that is capable of isolating said second source of power from said rivet gun. Preferably, the system further comprises: a bucking bar control system comprising a computer for acquiring and processing data relating to rivet driving; a power subsystem, a sensor array subsystem, and a control and communication subsystem. Preferably, said power subsystem includes rechargeable battery and/or an external power supply, and a power regulator. Preferably, said sensor array subsystem includes a plurality of bucking bar sensors and a plurality of rivet gun sensors. Preferably, said control and communication subsystem includes a pneumatic solenoid having a driver relay, a plurality of communication indicators, a communication port, a graphical user interface and a keypad.

In yet another preferred embodiment, the invention is a method for controlling a system for setting a rivet in a work piece with a rivet gun and a bucking bar, said method comprising: initializing the system; waiting to receive a first signal from a first sensor that indicates that a rivet gun operator is ready to commence riveting; when said first signal is received, illuminating a rivet gun operator indicator light and a bucking bar operator indicator light; waiting to receive a second signal from a second sensor that indicates that a bucking bar operator is ready to commence riveting; when said second signal is received, flashing said rivet gun operator indicator light and said bucking bar operator indicator light on and off; optionally, starting a first user selectable time delay; enabling the operation of said rivet gun by actuating a solenoid coupling said rivet gun to a air supply source; beginning a rivet setting operation; sensing that said rivet setting operation has begun and then starting a timer, counting the number of impact blows from the rivet gun and waiting to receive a rivet head height threshold detection signal; when said rivet head height threshold detection signal is received, stopping the rivet gun, stops said timer, turning off said indicator lights and, optionally, starting a second user selectable time delay. Preferably, the method further comprises: determining a strength of the rivet; displaying a recommended rivet gun air pressure setting and/or adjusting a rivet gun air pressure setting; and logging a set rivet head height.

In another preferred embodiment, the invention is a bucking bar for forming a rivet head, said bucking bar comprising: a housing having a cavity and comprising a housing shoulder; a plunger that is slidably mounted in said cavity and that is held within said cavity by said housing shoulder, said plunger comprising a plunger stem that has a proximal shoulder; a cap screw that is mounted on said proximal shoulder; a hammer that is slidably mounted in said plunger, said hammer having an anvil face at one end and a cap at another end; a compression spring that is disposed within said cavity and that has a first end that rests on said cap and a second end that rests on said proximal shoulder. Preferably, the bucking bar further comprises: a photo switch that is mounted on said housing within said cavity, said photo switch being operative to actuate or toggle states when said cap screw is detected by said photo switch.

In another preferred embodiment, the invention is a backriveting system, said backriveting system comprising: a plunger comprising a proximal shoulder and having a cavity; an internal collar that is slidably movable within said cavity; a rivet set tool having a set tool stem that extends through said cavity and through said internal collar, said rivet set tool having one end having an anvil face and another end being attachable to a rivet gun and said set tool stem being fixed to said internal collar; a compression spring having a first end that rests on said internal collar and a second end that rests on said proximal shoulder; an exterior collar that is attachable to said stem; and a switch that is attached to said plunger and that is operative to actuate or toggle states when the position of said exterior collar relative to said switch indicates that a desired set rivet head height has been achieved or (alternatively) when said switch indicates that a rivet gun operator is ready to begin riveting.

In yet another preferred embodiment, the invention is a bucking bar for forming a rivet head on a rivet in a work piece, said bucking bar comprising: a housing having a cavity having an interior surface upon which is provided a key or axially-positioned tab; a first embedded switch that is embedded in said housing; a plunger that is slidably mounted in said cavity, said plunger comprising a plunger stem that has exterior threads, a proximal shoulder, a collar and a shroud; a traveling nut that has interior threads that are operative to engage with said exterior threads on said plunger, said traveling nut having a groove that is operative to engage with said said key or axially-positioned tab to achieve axial slidable movement of said traveling nut; a hammer, a portion of which is mounted in said plunger, said hammer having an anvil face at one end and a cap at another end; a switch housing collar that is mounted within said cavity; a second embedded switch that is attached to said switch housing collar; and a compression spring that is disposed within said cavity and that has a first end that rests on said switch housing collar and a second end that rests on said proximal shoulder; wherein said first embedded switch is operative to toggle switch state when said collar of said plunger moves axially upward relative to said housing; and wherein said second embedded switch is operative to toggle switch state when the position of said traveling nut relative to said switch indicates that a desired set rivet head height has been achieved. Preferably, the bucking bar further comprises: three electrical conducting contact points disposed about 120 degrees apart around said shroud; a wire connecting each of said electrical conducting contact points to a computer that is operative to detect which of said three electrical conducting contact points are resting on said work piece. Preferably, the bucking bar further comprises: three indicator lights disposed about 120 degrees apart around said shroud, any number of said three indicator lights being operative to illuminate if directed to do so by said computer. Preferably, the bucking bar further comprises: three electrical conducting contact points disposed about 120 degrees apart around said shroud; a wire connecting each of said electrical conducting contact points to a computer that is operative to detect which of said three electrical conducting contact points are resting on said work piece. Preferably, the bucking bar further comprises: three indicator lights disposed about 120 degrees apart around said shroud, any number of said three indicator lights being operative to illuminate if directed to do so by said computer.

In another preferred embodiment, the invention is a system for setting a rivet in a work piece, said rivet having a rivet manufactured head and a rivet shank, said system comprising: a rivet gun having a rivet set tool that is energized by a pressurized fluid that must pass through a solenoid valve, said solenoid valve having a first port through which said pressurized fluid enters said solenoid valve and a second port through which said pressurized fluid must pass to reach said rivet gun; an augmented bucking bar having a contact; a first source of direct current that is disposed in a first normally open electrical circuit that also includes a first work piece, a first indicator light and said rivet set tool connected in series, said first source of direct current being operative to illuminate said first indicator light when said rivet set tool is placed in contact with said rivet manufactured head; a second source of direct current that is disposed in a second normally open electrical circuit that also includes a second work piece, a second indicator light and said augmented bucking bar connected in series, said second normally open electrical circuit also being connected to a relay, said second source of direct current being operative to illuminate said second indicator light when said augmented bucking bar is placed in contact with said rivet shank; a third source of direct current that is disposed in a third normally open electrical circuit that also includes said second work piece, said relay and said contact connected in series, said third source of direct current being operative to actuate said relay when said contact is brought in contact with said second work piece during a riveting cycle (operatively, this circuit is formed when the driven rivet height is substantially equal to the desired set rivet head height); and a fourth source of direct current that is disposed in a fourth normally open electrical circuit that also includes said relay and said solenoid valve, said fourth source of direct current being operative to close said first port of said solenoid valve when said relay is actuated. Preferably, said solenoid valve is a three-port solenoid valve comprising a third port that is connected to an ambient atmosphere and said fourth source of direct current being operative to close the first port and open the second port and said third port of said solenoid valve when said relay is actuated, thereby allowing backpressure from said rivet gun to be exhausted from the rivet gun to said ambient atmosphere.

In yet another preferred embodiment, the invention is a method for controlling a system for setting a rivet in a work piece with a rivet gun that is operated by a rivet gun operator and a bucking bar that is operated by a bucking bar operator, said method comprising: initializing system components and disabling the rivet gun; conducting system tests, comprising detecting whether the rivet gun operator is ready to begin riveting, detecting whether the bucking bar operator is ready to begin bucking and monitoring the system for system errors; turning system LEDs on, including turning on the bucking bar operator's LED to indicate the bucking bar operator that the rivet gun operator is ready to begin riveting and turning the rivet gun operator's LED on to verify that the bucking bar operator's LED has been turned on; detecting that the bucking bar operator is ready to begin bucking, enabling the rivet gun and flashing said LEDs on-and-off to indicate to both operators that the bucking bar operator is ready to begin bucking, continuing to monitor the system for said system errors and for calibration requests and disabling the rivet gun when desired set rivet head height has been achieved; if one of said system errors is detected, ceasing riveting and informing the operators of the error condition; if a calibration request is received, allowing at least one of said operators to calibrate the system; and resetting the system. Preferably, said conducting system tests step further comprises: detecting whether a rivet head height detection sensor is working, determining whether the rivet gun operator has set up on a rivet and then disengaged, determining whether the bucker has removed the bucking bar from the rivet, detecting whether a calibration mode has been requested by one of the operators or alternately by the system, and detecting when a system reset is requested by at least one of the operators or by the system following the end of a rivet driving cycle, following operation of an error management subroutine, or following operation of a calibration management subroutine. Preferably, the method further comprises: counting the number of rivets driven and invoking an automatic calibration check after the system is used to set a predetermined number of rivets. Preferably, the method further comprises: counting the number of impacts it takes to set a rivet and/or measuring each rivet setting time.

In another preferred embodiment, the invention is a system for setting a rivet in a work piece, said rivet having a rivet manufactured head and a rivet shank, said system comprising: a rivet gun having a rivet set tool that is wired to a first circuit subassembly that is wired to a first work piece, said rivet set tool being operative to generate a first signal when it is placed on the rivet manufactured head; a bucking bar that is wired to or integral with a second circuit subassembly that is in radio frequency communication with said first circuit subassembly, or that is in radio frequency communication with a third circuit subassembly that is in radio frequency communication with said first circuit subassembly, said bucking bar being operative to generate a second signal when it is placed on the rivet shank and being operative to generate a third signal when the rivet is set; a solenoid valve that is wired to a fourth circuit subassembly that is in radio frequency communication with said first circuit subassembly, or that is in radio frequency communication with a third circuit subassembly that is in radio frequency communication with said first circuit subassembly, said solenoid valve being operative to enable and disable said rivet gun; a computer or data logger that is wired to a fifth circuit subassembly that is in radio frequency communication with said first circuit subassembly and said second circuit subassembly, or that is in radio frequency communication with a third circuit subassembly that is in radio frequency communication with said first circuit subassembly and said second circuit subassembly, said computer or data logger being operative to monitor productivity. Preferably, the system further comprises: a pressure regulator that is wired to a sixth circuit subassembly that is in radio frequency communication with at least one of said first circuit subassembly, said second circuit subassembly, said third circuit subassembly, said fourth circuit subassembly and said fifth circuit subassembly, said pressure regulator being operative to control the pressure being imposed on said solenoid valve and, thereby, on said rivet gun. A person having ordinary skill in the art would understand that any means of radio communication could be used to accomplish this function.

In yet another preferred embodiment, the invention is a method for setting a rivet in a work piece, said method comprising: attaching a sensor pad having a thickness equal to a desired rivet head height to said work piece; driving a rivet having a rivet manufactured head and a rivet shank by forcing said rivet shank against a bucking bar with a rivet gun to produce said driven rivet head having a height; determining whether said height is substantially equal to a desired set rivet head height; and ceasing driving said rivet when said height is equal to said desired rivet head height. Preferably, said bucking bar being held by a bucker and said rivet gun is being held by a rivet gun operator, and said method further comprises: prior to said driving step, transmitting a rivet gun operator ready signal to said bucker when said rivet gun contacts said rivet manufactured head, thereby indicating to said bucker that said rivet gun operator is ready; and transmitting a bucker ready signal to said rivet gun operator after sensing when said bucking bar contacts said rivet shank, thereby indicating to said rivet gun operator that said bucker is ready. Preferably, the method further comprises: prior to said ceasing step (described above), transmitting an end of riveting cycle signal to said rivet gun operator when said bucking bar contacts said sensor pad. Preferably, the method further comprises: applying a force to said work piece after said rivet gun operator ready signal is transmitted and before said bucker ready signal is transmitted. Preferably, said bucking bar contacting said rivet shank is accomplished by the bucker's compressing a spring loaded plunger that is applying a force to said work piece.

In yet another embodiment, the invention is a system for setting a rivet in a work piece, said system comprising: means for driving a rivet having a rivet manufactured head and a rivet shank by forcing said rivet shank against a bucking bar with a rivet gun to produce said driven rivet head having a height; means for determining whether said height is substantially equal to a desired set rivet head height; and means for ceasing driving said rivet when said height is equal to said desired rivet head height.

In another preferred embodiment, the invention is a method for setting a rivet in a work piece, said rivet having a rivet manufactured head and a shank having a shank end, said method comprising: sensing when a rivet set tool of a rivet gun has been placed in electrical communication with the rivet and indicating that said rivet set tool is ready; sensing when a bucking bar has been placed in electrical communication with the rivet and indicating that said bucking bar is ready; driving the rivet by forcing the shank against said bucking bar with said rivet set tool to form a driven rivet head; determining when the height of said driven rivet head is substantially equal to a desired set rivet head height and indicating that said desired set rivet head height has been achieved; and ceasing driving the rivet. Preferably, said sensing steps and/or determining step comprises completing electrical circuits. Preferably, said indicating steps comprise turning lights on or off and/or flashing lights on and off. Preferably, said determining step further comprises disabling said rivet gun. Preferably, said disabling step comprises actuating a solenoid valve on a compressed air line from a compressed air source to said rivet gun to decouple said rivet gun from said compresses air. Preferably, said driving step comprises forcing an anvil face against the shank and simultaneously pushing a plunger having a shoulder and a base against the work piece, thereby causing said anvil face to move toward said base as said driven rivet head is formed. Preferably, said forcing step comprises compressing a spring that urges said base against said work piece when said anvil face is forced against said shank. Preferably, said determining step (described above) comprises sensing when said shoulder or said base is displaced away from a plane containing at least a portion of said anvil face a selected distance. Preferably, or more of said indicating steps comprises a radio frequency communication. Preferably, the method further comprises monitoring contact between said bucking bar and the rivet shank and counting hammer blows during the driving step.

In yet another preferred embodiment, the invention is a method for setting a rivet in a work piece, said rivet having a rivet manufactured head and a shank having a shank end, said method comprising: a step for sensing when a rivet set tool of a rivet gun has been placed in electrical communication with the rivet and indicating that said rivet set tool is ready; a step for sensing when a bucking bar has been placed in electrical communication with the rivet and indicating that said bucking bar is ready; a step for driving the rivet by forcing the shank against said bucking bar with said rivet set tool to form a driven rivet head; a step for determining when the height of said driven rivet head is substantially equal to a desired set rivet head height and indicating that said desired set rivet head height has been achieved; and a step for ceasing driving the rivet.

In another preferred embodiment, the invention is a system for setting a rivet in a work piece, said rivet having a rivet manufactured head and a shank having a shank end, said system comprising: means for sensing when a rivet set tool of a rivet gun has been placed in electrical communication with the rivet and indicating that said rivet set tool is ready; means for sensing when a bucking bar has been placed in electrical communication with the rivet and indicating that said bucking bar is ready; means for driving the rivet by forcing the shank against said bucking bar with said rivet set tool to form a driven rivet head; means for determining when the height of said driven rivet head is substantially equal to a desired set rivet head height and indicating that said desired set rivet head height has been achieved; and means for ceasing driving the rivet.

In yet another embodiment, the invention is a system for determining when a rivet gun set tool contacts a manufactured head and when an anvil face of a bucking bar tool contacts a rivet shank, said system comprising: means for determining when the rivet gun set tool contacts the manufactured head and when the anvil face of the bucking bar tool contacts the rivet shank that are incorporated into said rivet gun set tool and/or into the bucking bar tool; and means for informing an operator when the rivet gun set tool contacts the manufactured head and when the anvil face of the bucking bar tool contacts the rivet shank In another illustrative embodiment, the invention is a tool for forming a rivet head on a rivet shank, said tool comprising: a housing having a cap portion and having housing portions defining a cavity extending from the cap; a plunger that is slidably mounted in said housing cavity, said plunger having portions defining a shroud; a hammer attached to said housing, said hammer comprising a hammer head slidably engaged within said plunger shroud and an anvil face formed on the hammer head; and a resilient loading device acting between said housing and said plunger to nominally exert a load on said plunger. In another embodiment, said housing has other portions defining a cylinder stem that protrudes into the housing cavity; and said plunger has plunger portions comprise a plunger stem that slidably engages with the cylinder stem to assist in aligning said plunger with said housing. In another embodiment, said hammer has hammer portions defining a shank stem, said shank stem extending from the hammer head to the cap portion of the housing to fix the hammer head to the housing. In another embodiment, the resilient loading device comprises a spring engaged over the hammer shank stem, said hammer shank stem serving as a guide for said spring. In another embodiment, the tool further comprises a first sensor disposed within said housing cavity to sense the position of the anvil face, said first sensor being operative to change its state when the position of the anvil face indicates that a desired set rivet head height has been achieved. In another embodiment, the first sensor senses the position of the plunger relative to the housing. In another embodiment, the first sensor senses the position of the plunger relative to the anvil face. In another embodiment, the first sensor is adjustable to selectively change a desired rivet head height.

In another embodiment, the tool further comprises: a conducting post that is attached to said cap and disposed in said cavity, said conducting post being in electrical communication with said anvil face; a first electrical conductor that is in electrical communication with a work piece and that is operative to form a conducting path from said work piece through the rivet and said anvil face to said conducting post, thereby providing a second sensor that is operative to sense when said anvil face is in contact with the rivet; a bucking bar visual indicator that is attached to the housing; a second electrical conductor that connects a computer to said conducting post to provide means for determining the state of said second sensor and detecting when said anvil face is in contact with the rivet or detecting when said anvil face is not in contact with the rivet; a third conductor that connects said bucking bar visual indicator to a ground and to a power source, to computer control said bucking bar visual indicator to effectuate means for communicating a driving stage to a user; and wherein said bucking bar visual indicator is operative in a first fashion when a rivet gun operator is ready to commence riveting and in a second fashion when a rivet gun operator and a bucking bar operator are both ready to commence riveting. In another embodiment, said plunger further comprises a spindles feet that is disposed around said hammer and beyond said anvil face.

In another embodiment, the tool further comprises: a plurality of electrical conducting contact points disposed around said plunger shroud; an electrical conductor connecting each of said electrical conducting contact points to a computer that is operative to detect which of said conducting contact points are resting on a work piece. In another embodiment, the tool further comprises: a computer; and a plurality of visual indicators disposed around said shroud, any number of said visual indicators being operative if directed to do so by said computer.

In yet another illustrative embodiment, the invention is a tool in the form of a bucking bar tool or a rivet gun set tool, for use with a rivet gun in forming a rivet head on a rivet shank end by deforming the rivet shank, said tool comprising: a hammer having an anvil face; a plunger comprising: portions for slidably engaging said hammer; and a spindles feet, said spindles feet extending beyond said anvil face; a loading member that is operative to nominally urge said spindles feet beyond said anvil face; a first sensor that is operative to measure a first distance or a gap height between said anvil face and said spindles feet; and a controller that is operative to couple or decouple the rivet gun from a power supply, thereby enabling or disabling the rivet gun. In another embodiment, said controller is operative to disable said rivet gun when said first distance or gap height substantially matches a desired rivet head height.

In another embodiment, the tool further comprises a second sensor that is operative to sense when said anvil face contacts either a rivet manufactured head or the rivet shank end. In another embodiment, the tool further comprises an indicator that is operative to indicate to a user when said second sensor senses said contact, said indicator being under the control of said controller. In another embodiment said controller is operative to disable a rivet gun when said anvil face is disengaged from the shank end during a rivet driving stage.

In a further illustrative embodiment, the invention is a tool in the form of a bucking bar tool or a rivet gun set tool for setting a rivet, the rivet having a manufactured head and a shank having a shank end, said tool comprising: a hammer having an anvil face; a second sensor that is operative to sense when said anvil face makes a contact with either a rivet manufactured head or the shank end; an indicator that is operative indicate when said second sensor senses said contact; and a controller that operative to actuate said indicator, thereby informing a user when said anvil face makes said contact. In another embodiment, said indicator comprises a first visual indicator; and said controller is operative to actuate said first visual indicator when said bucking bar tool contacts either the manufactured head or the shank end. In another embodiment, said indicator comprises a second visual indicator; and said controller actuates said second visual indicator when said rivet gun set tool contacts either the manufactured head or the shank end.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 1A:
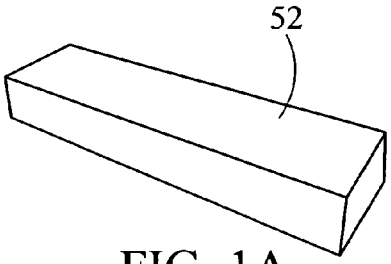
FIG. 1A PRIOR ART
FIGS. 1A through 1D present perspective views of conventional bucking bars used in the prior art.
Figure 1B:
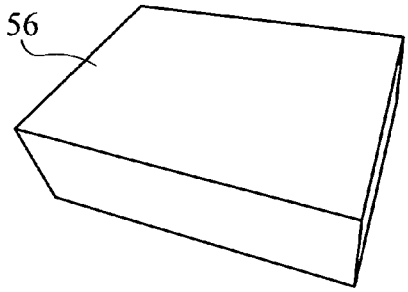
FIG. 1B PRIOR ART
Figure 1C:
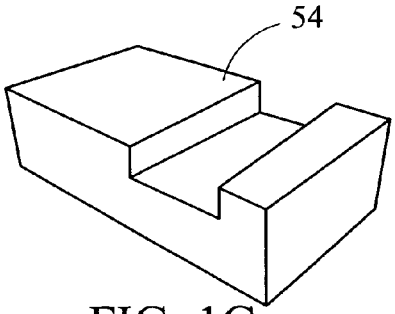
FIG. 1C PRIOR ART
Figure 1D:
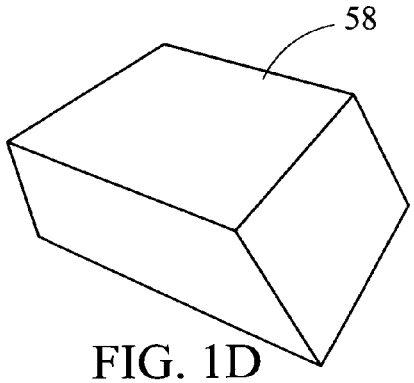
FIG. 1D PRIOR ART

The following reference numerals are used to indicate the parts and environment of the invention on the drawings:

| | |
|---|---|
| 52 | first common bucking bar |
| 52' | augmented bucking bar |
| 54 | second common bucking bar |
| 56 | third common bucking bar |
| 58 | fourth common bucking bar |
| 62 | common rivet, universal head rivet |
| 64 | counter-sunk rivet, flush rivet |
| 66 | rivet manufactured head, manufactured head |
| 68 | rivet shank |
| 70 | end of rivet shank, rivet shank end |
| 72 | first work piece |
| 73 | second work piece |
| 74 | first facing surface |
| 76 | second facing surface |
| 78 | work thickness |
| 80 | distance |
| 82 | rivet head width |
| 84 | desired set rivet head height |
| 84a | low side rivet head height |
| 84b | high side rivet head height |
| 84c | overdriven rivet head height |
| 84d | underdriven rivet head height |
| 86 | rivet head |

-continued

| | |
|---|---|
| 96 | air gap |
| 98 | bulge |
| 100 | rivet fastening system |
| 102 | pneumatic rivet gun, rivet gun |
| 104 | rivet set tool, set tool |
| 106 | positive low voltage DC power supply, power supply source |
| 108 | first conducting wire |
| 110 | air hose |
| 112 | electro-mechanical solenoid valve, solenoid valve |
| 114 | first LED indicator light |
| 116 | second conducting wire |
| 118 | ground |
| 124 | second LED indicator light |
| 126 | third conducting wire |
| 128 | sensor pad |
| 130 | electrically-conductive contacting surface, contact |
| 134 | fourth conducting wire |
| 136 | third LED indicator light |
| 138 | fourth LED indicator light |
| 212 | rivet gun operator control circuit board, first circuit board |
| 212' | bucker control circuit board, second circuit board |
| 212" | RF repeater circuit board, third circuit board |
| 212''' | data acquisition system, fourth circuit board |
| 212'''' | solenoid control circuit board, fifth circuit board |
| 212''''' | air regulator control circuit board, sixth circuit board |
| 214 | mounted LED indicator light, first indicator light |
| 216 | mounted LED indicator light bar |
| 218 | user selectable position switches |
| 220 | first conducting lead wire |
| 226 | second conducting lead wire |
| 232 | first multi-conductor cable |
| 236 | second multi-conductor cable |
| 237 | third multi-conductor cable |
| 238 | bucking bar |
| 240 | bucking bar indicator LED light, second indicator light |
| 240" | second indicating LED |
| 250 | cap bolt fastener |
| 252 | micro-adjustable jackscrew, jackscrew |
| 254 | cap |
| 256 | conducting post |
| 257 | longitudinal axis |
| 258 | e-spring clip, clip |
| 260 | housing |
| 262 | housing bolt fasteners |
| 264 | traveling nut |
| 266 | compression spring |
| 268 | plunger |
| 270 | hammer |
| 300 | anvil face |
| 302 | interior cylinder stem, cylinder stem |
| 304 | distal shoulder |
| 306 | plunger stem |
| 308 | plunger shoulder |
| 310 | proximal shoulder |
| 312 | spindles feet, lip |
| 312' | first contact point |
| 312" | second contact point |
| 313''' | third contact point |
| 314 | first distance |
| 318 | proximal surface |
| 320 | housing and plunger surfaces |
| 322 | hammer and plunger surfaces |
| 323 | cylinder stem and plunger stem surfaces |
| 325 | hammer stem |
| 326 | hammer stem and plunger surfaces |
| 327 | hammer base |
| 350 | microswitch, switch |
| 352 | switch lever arm |
| 354 | jack-plug assembly |
| 358 | momentary push-button switch and indicator LED light assembly |
| 360 | first internal wire |
| 362 | third internal wires |
| 364 | second internal wires |
| 366 | housing and traveling nut surfaces |
| 368 | plunger stem and traveling nut surfaces |
| 371 | first switch chatter signature |
| 371' | second switch chatter signature |
| 373 | first contact bounce signature |
| 373' | second contact bounce signature |

-continued

| | |
|---|---|
| 375 | first falling edge hammer signature |
| 375' | second hammer signature |
| 377 | time interval |
| 500 | controller |
| 502 | processor(s) |
| 504 | random access memory, RAM, memory |
| 506 | read only memory, ROM |
| 508 | bus |
| 510 | storage device |
| 512 | input/output device(s) |
| 514 | sensor interface |
| 520 | bucking bar control system |
| 522 | computer |
| 524 | power subsystem |
| 526 | sensor array subsystem |
| 528 | control and communication subsystem |
| 530 | rechargeable battery, battery |
| 532 | power regulator, regulator |
| 534 | external power supply, power supply |
| 540 | pneumatic solenoid, solenoid |
| 542 | communication indicators |
| 544 | communication port |
| 546 | graphic user interface |
| 548 | keypad, interface |
| 550 | initialize step |
| 552 | detect "AG Ready" step |
| 554 | gun ready conditional step |
| 556 | turn LEDs on step |
| 558 | detect "BB Ready" step |
| 560 | bucker ready conditional step |
| 562 | initiate riveting step |
| 564 | detect start rivet step |
| 566 | rivet start conditional step |
| 568 | start timer/count impacts step |
| 570 | detect height threshold conditional step |
| 572 | end riveting cycle step |
| 574 | first interrupt service request step |
| 576 | second interrupt service request step |
| 578 | forced recalibration step |
| 580 | conduct calibration, calibration mode |
| 582 | stop rivet gun IRQ from "detect if user disengaged work during driving cycle" in block 568 |
| 600 | cap screw |
| 602 | access port |
| 605 | slot type photointerrupter switch |
| 606 | strain relief device |
| 992 | radio frequency signals |
| 611 | housing shoulder |
| 650 | external collar |
| 652 | external setscrew |
| 654 | internal collar |
| 656 | internal setscrew |
| 702 | threaded traveling nut |
| 704 | key, axially-positioned tab, tab |
| 706 | switch housing collar |
| 708 | first embedded switch |
| 710 | second embedded switch |
| 712 | shoulder of collar |
| 713 | shoulder of housing |
| 802 | first battery |
| 804 | second battery |
| 806 | third battery |
| 808 | relay |
| 810 | fourth battery |
| 902 | NPN type transistor |
| 904 | solenoid driver |
| 906 | user activated switch |
| 908 | calibration mode LED |
| 950 | start step |
| 952 | initialize system step |
| 954 | main program step |
| 956 | rivet gun operator ready step, bucker ready block |
| 958 | bucker ready step, bucker ready block |
| 960 | error detection step, fault management step, error detection block |
| 962 | calibration step, calibration block |

-continued

| | |
|---|---|
| 964 | system reset step, system reset block |
| 990 | pressure regulator |
| 992 | RF signals |
| 994 | management computer |

DETAILED DESCRIPTION OF THE INVENTION

The following description of the preferred embodiments of the invention is merely exemplary in nature and is in no way intended to limit the invention, its application, or uses. In preferred embodiments, the rivet fastening system disclosed herein is configured to control the rivet setting process and the resultant rivet set.

Referring to FIGS. 1A through 1D, prior art examples of common conventional bucking bars are illustrated. Conventional bucking bars are used to back up rivets during the fastening process and comprise a metal mass typically having a hardened material and a polished anvil face for impacting the rivets. Conventional bars come in numerous bar shapes, illustrated here by first common bucking bar 52, second common bucking bar 54, third common bucking bar 56 and fourth common bucking bar 58.

Figure 2A:
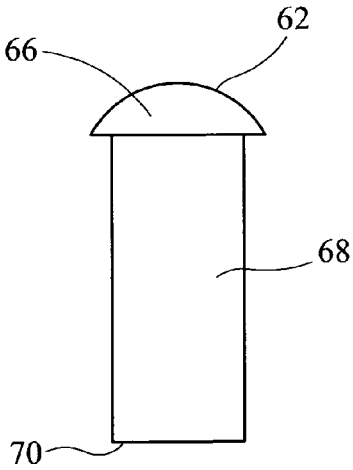
FIG. 2A PRIOR ART
FIGS. 2A and 2B present elevation views of two types of prior art rivet fasteners.
Figure 2B:
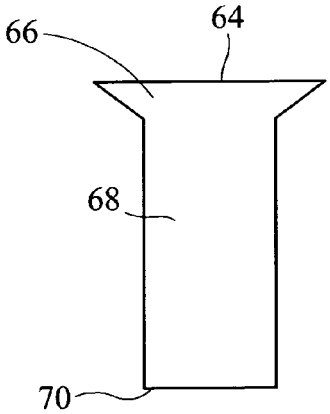
FIG. 2B PRIOR ART

Referring to FIGS. 2A and 2B, examples of two typical prior art solid-core rivets are presented. A first type of rivet is a common or universal head rivet 62, a second type of rivet is a counter-sunk or flush rivet 64. Both types of rivets are comprised of manufactured head 66, rivet shank 68 and end of rivet shank 70.

Figure 3:
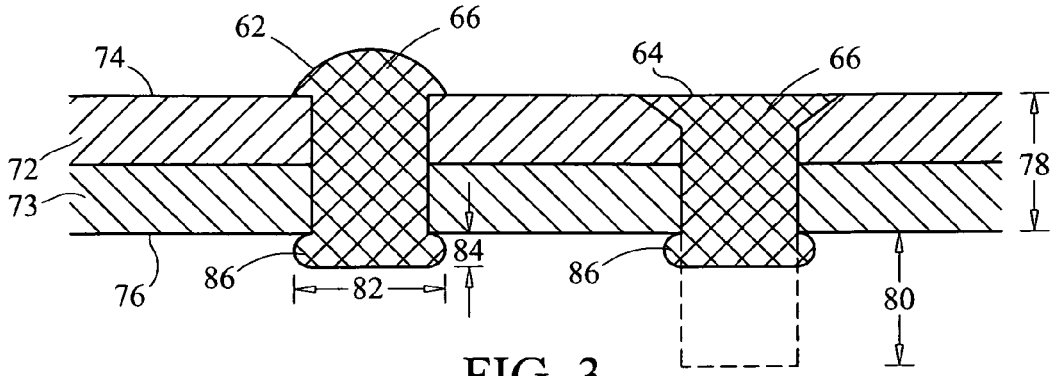
FIG. 3 PRIOR ART
FIG. 3 is an elevation view illustrating properly set rivets of the types shown in FIGS. 2A and 2B.

Referring to FIG. 3, examples of properly set prior art rivets are illustrated. The rivets are used to fasten a plurality of work pieces 72, 73 having combined work thickness 78 together. Manufactured head 66 secures first work piece 72 having first facing surface 74 while the driven rivet head 86 secures second work piece 73 having second facing surface 76. Typically, when undriven, rivet shank 68 initially protrudes beyond surface 76 a distance 80 of about 1½ times work thickness 78. When set, rivet head 86 typically has a rivet head width 82 of about 1¼ times the diameter of rivet shank 68 and has a desired set rivet head height 84 of about ½ A of the diameter of rivet shank 68. Thus, when properly sizing rivets to work thickness 78, typically a rivet width 82 is a directly proportional function of rivet height 84 and visa versa. Preferred embodiments of this invention provide configurations to achieve measurement of the rivet head height in real-time or near real time using preferred sensing technologies coupled with the teachings (presented later) best suited for this measurement. However, a person having ordinary skill in the art would understand that should other sensing technologies be developed or identified to measure rivet head width 82 in real-time or near real time, these sensors could be incorporated into this invention without changing the intent or concept of this invention. It is also realized that other sensing technologies for measurement of the rivet head height in real-time or near real time may be developed or may be identified to further improve this invention. Incorporation of such sensors are also considered not to alter the intent or concept of this invention.

Figure 4A:
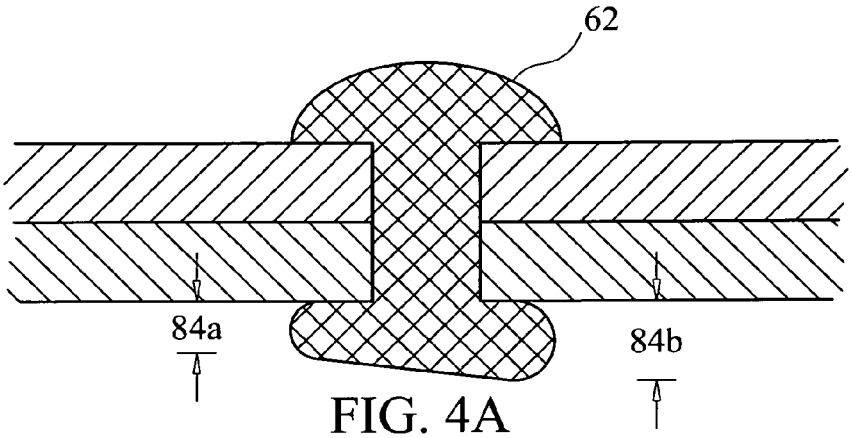
FIG. 4A PRIOR ART
FIG. 4A is an elevation view of an improperly set prior art rivet of the type shown in FIG. 2A.

Referring to FIG. 4A, an illustration of an improperly set prior art common rivet 62 is presented. Set low side rivet head height 84*a* is less than minimum allowed height tolerance and/or set high side rivet head height 84*b* is greater than maximum allowed height tolerance. This illustration depicts a misshapen rivet head resulting from tool misalignment (by not holding the bucking bar orthogonal to the work surface).

Figure 4B:
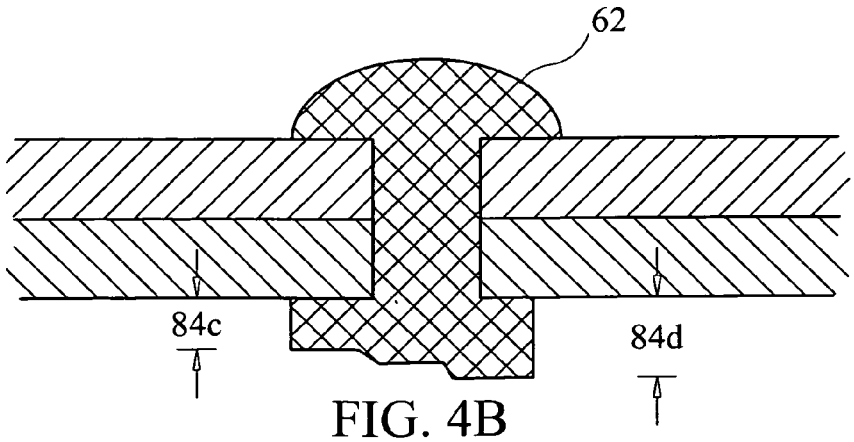
FIG. 4B PRIOR ART
FIG. 4B is an elevation view of an improperly set prior art rivet of the type shown in FIG. 2A.

Referring to FIG. 4B, an illustration of an improperly set rivet 62 is presented. Set overdriven rivet head height 84*c* is less than minimum allowed height tolerance and/or set underdriven rivet head height 84*d* is greater than maximum allowed height tolerance. This illustration depicts a misshaped rivet head resulting from the anvil face slipping off the rivet head during the rivet fastening process.

Figure 4C:
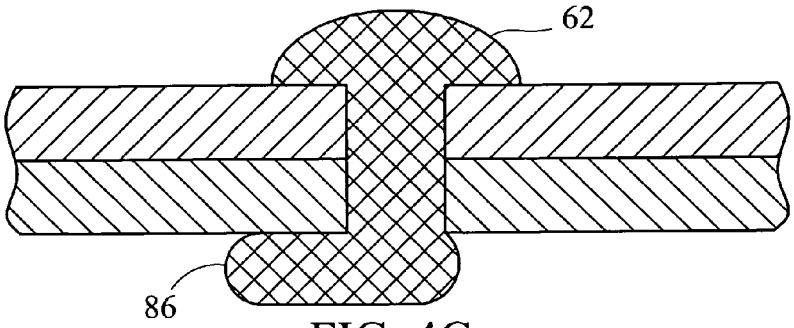
FIG. 4C PRIOR ART
FIG. 4C is an elevation view of an improperly set prior art rivet of the type shown in FIG. 2A.

Referring to FIG. 4C, an illustration of another improperly set rivet 62 presented. In this instance, set rivet head 86 is not centered on the longitudinal axis of rivet shank 68. This set rivet shape results from side-loads being applied to the rivet during the rivet driving stage and such an improperly set rivet does not adequately secure the work pieces together.

Figure 4D:
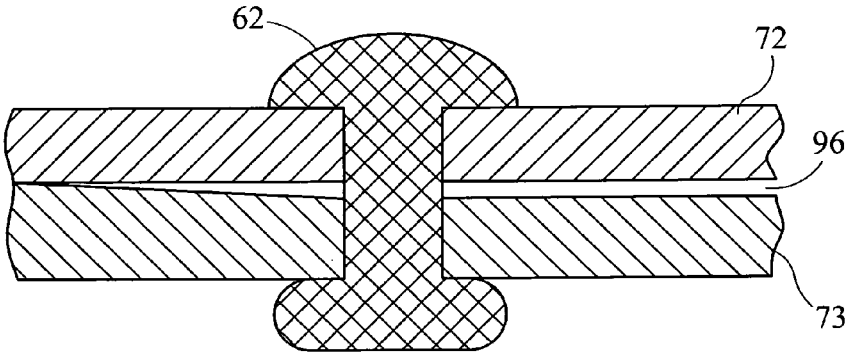
FIG. 4D PRIOR ART
FIG. 4D is an elevation view of an improperly set prior art rivet of the type shown in FIG. 2A.

Referring to FIG. 4D, an illustration of another improperly set rivet 62 is presented. In this instance, rivet 62 is set in a manner that allows a first type of air gap 96 to be formed between work pieces 72 and 73. Again, this results in a set rivet that does not adequately secure the work pieces together.

Figure 4E:
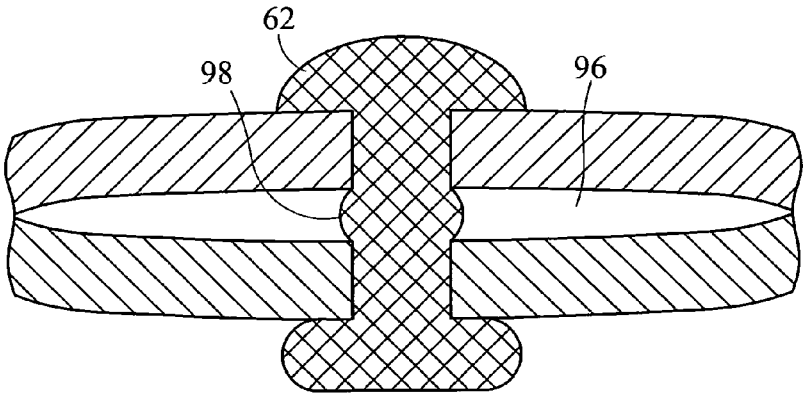
FIG. 4E PRIOR ART
FIG. 4E is an elevation view of an improperly set prior art rivet of the type shown in FIG. 2A.

Referring to FIG. 4E, an illustration of another improperly set rivet 62 is presented. In this instance, rivet 62 is set in a manner that allows a second type of air gap 96 to be formed between work pieces 72 and 73. This also results in a set rivet that does not adequately secure the work pieces together. Furthermore, in this instance, rivet shank 68 expands during the rivet setting process forming bulge 98, which prevents the work pieces from coming together flush and renders the rivet difficult to remove for rework. The situations depicted in FIGS. 4D and 4E show improperly set rivets resulting from the work pieces not being adequately pressed together during the riveting process. FIGS. 4A-4E illustrate out of tolerance set rivets that do not adequately secure the work pieces together and require removal and rework resulting in extensive lost labor time and potential damage to the work surfaces or subsurfaces.

Figure 5A:
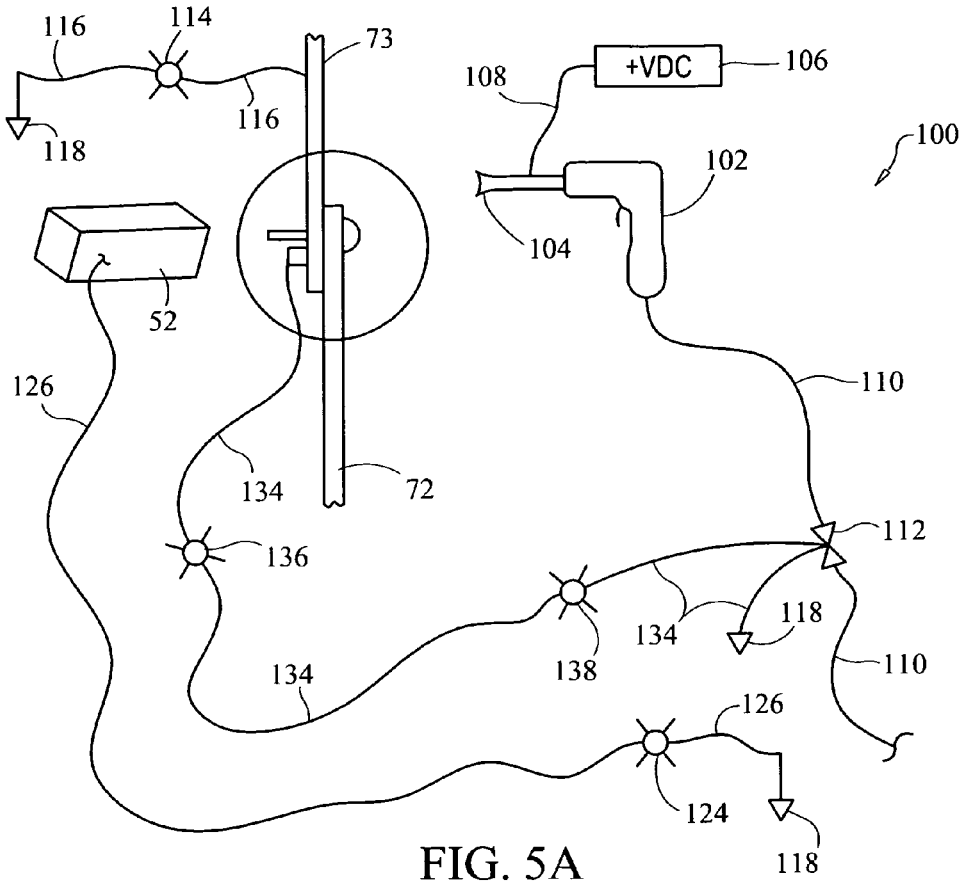
FIG. 5A is a schematic diagram of a preferred embodiment of the invention.
Figure 5B:
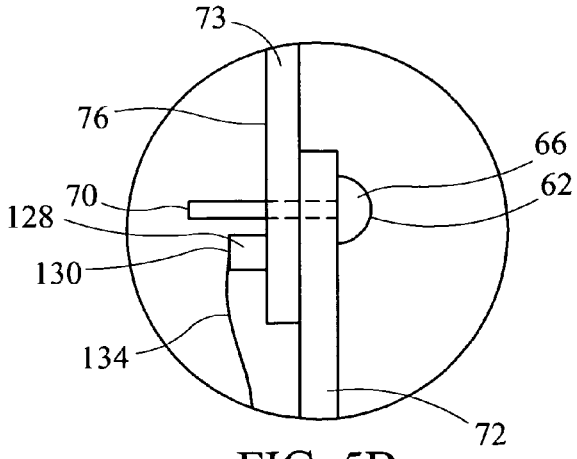
FIG. 5B is an elevation view of an aspect of the preferred embodiment of the invention illustrated in FIG. 5A

Referring to FIGS. 5A and 5B, a less preferred embodiment of the invention is illustrated. Although FIGS. 5A and 5B illustrate a less preferred embodiment of the invention, they are used to simplify and teach the invention. In this embodiment, rivet fastening system 100 comprises pneumatic rivet gun 102 equipped with rivet set tool 104. Set tool 104 is preferably connected to positive low voltage direct current (DC) power supply 106 by first conducting wire 108. Rivet gun 102 is preferably connected to an air reservoir (not shown) via air hose 110 with electro-mechanical solenoid valve 112 being located inline with (in series with) air hose 110 between rivet gun 102 and the air reservoir.

In this embodiment, second conducting wire 116 is coupled to work piece 73 that is connected in series with first LED indicator light 114 to ground 118. Thus, when set tool 104 contacts rivet manufactured head 66 and/or work piece 72 or 73, a first circuit is closed from power supply source 106 through rivet manufactured head 66 and/or work piece 72 or 73 and second conducting wire 116 to illuminate first LED indicator light 114 and thereby indicate to the bucker (bucker bar operator) that the rivet gun operator is "ready" to begin the rivet cycle.

In this embodiment, third conducting wire 126 is coupled to first common bucking bar 52 which is connected in series with second LED indicator light 124 to ground 118. Thus, when common bucking bar 52 contacts rivet shank end 70, a second circuit is closed from power supply source 106, first wire 106, through set tool 104 and rivet 62 to common bucking bar 52 and third conducting wire 126 to illuminate second LED indicator light 124 to indicate to the rivet gun operator that the bucker is also "ready" to begin the rivet cycle.

Finally, referring to FIG. 5B, in this embodiment, sensor pad 128 is adhesively affixed to second facing surface 76 adjacent to rivet shank 68. Sensor pad 128 is preferably comprised of an adhesive pad (not shown) on a first side and an electrically-conductive contacting surface 130 on a second (opposite) side which is coupled to fourth conducting wire 134. Sensor pad 128 is preferably comprised of a compressible material such as a memory foam that returns to its original height after compression force(s) are removed. Sensor pad 128 preferably has a height (measured between the described adhesive surface and conductive contacting surface 130) that matches desired set rivet head height 84.

Again referring to FIG. 5A, fourth conducting wire 134 is coupled in series to third LED light 136 and fourth LED light 138 and solenoid valve 112 between contacting surface 130 and ground 118. Thus, when bucking bar 52 contacts sensor pad 128 contacting surface 130 (this occurs when the driven rivet head 86 achieves desired set height 84), a third circuit is closed from source 106, first wire 108, through set tool 104, rivet 62, bucking bar 52, contacting surface 130 to illuminate third LED indicator light 136 and fourth LED indicator light 138 and close solenoid valve 112 to indicate to both operators that the rivet setting cycle is at an end. Solenoid valve 112 closes, disabling rivet gun 102 when rivet 62 has been set, thereby automatically stopping the riveting process.

Figure 6A:
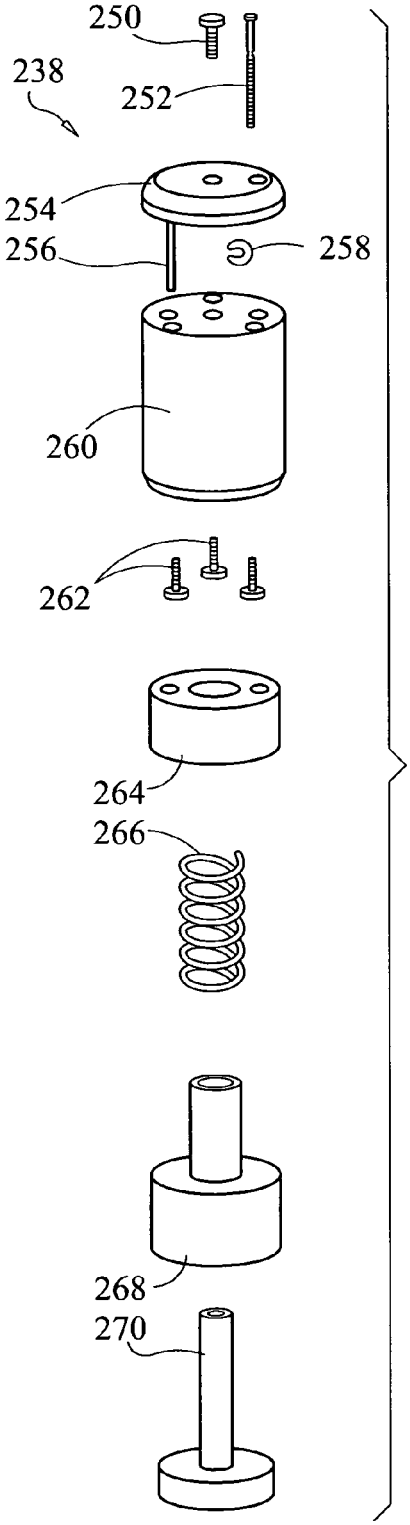
FIG. 6A is an exploded perspective view of the major mechanical components of a bucking bar in accordance with a more preferred embodiment of the invention.
Figure 6B:
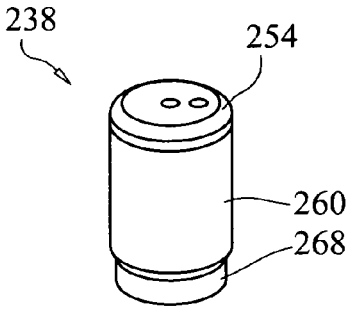
FIG. 6B is an assembled perspective view of the bucking bar presented in FIG. 6A.

Referring to FIG. 6A, an exploded view of a more preferred embodiment of bucking bar 238 is presented. In this embodiment, bucking bar 238 is comprised of cap bolt fastener 250, micro-adjustable jack screw 252, cap 254, conducting post 256, e-spring clip 258, housing 260, housing bolt fasteners 262, traveling nut 264, compression spring 266, plunger 268 and hammer 270. During assembly of bucking bar 238, jackscrew 252 is affixed to cap 254 by means of e-spring clip 258 (jack screw 252 is not threadedly engaged with cap 254 or with clip 258). Then, housing bolt fasteners 262 affix housing 260 to cap 254. Next, traveling nut 264 is threadedly engaged with jackscrew 252 forming a micro-adjustable traveling-nut-positioning jackscrew assembly. Next, compression spring 266 and plunger 268 are installed, guided by the shaft of hammer 270. The assembly process is completed by affixing the end of the shaft of hammer 270 to cap 254 with cap bolt fastener 250. Cap bolt fastener 250 is threadedly engaged with the end of the shaft of hammer 270. FIG. 6B shows a perspective view of assembled bucking bar 238.

Figure 7A:
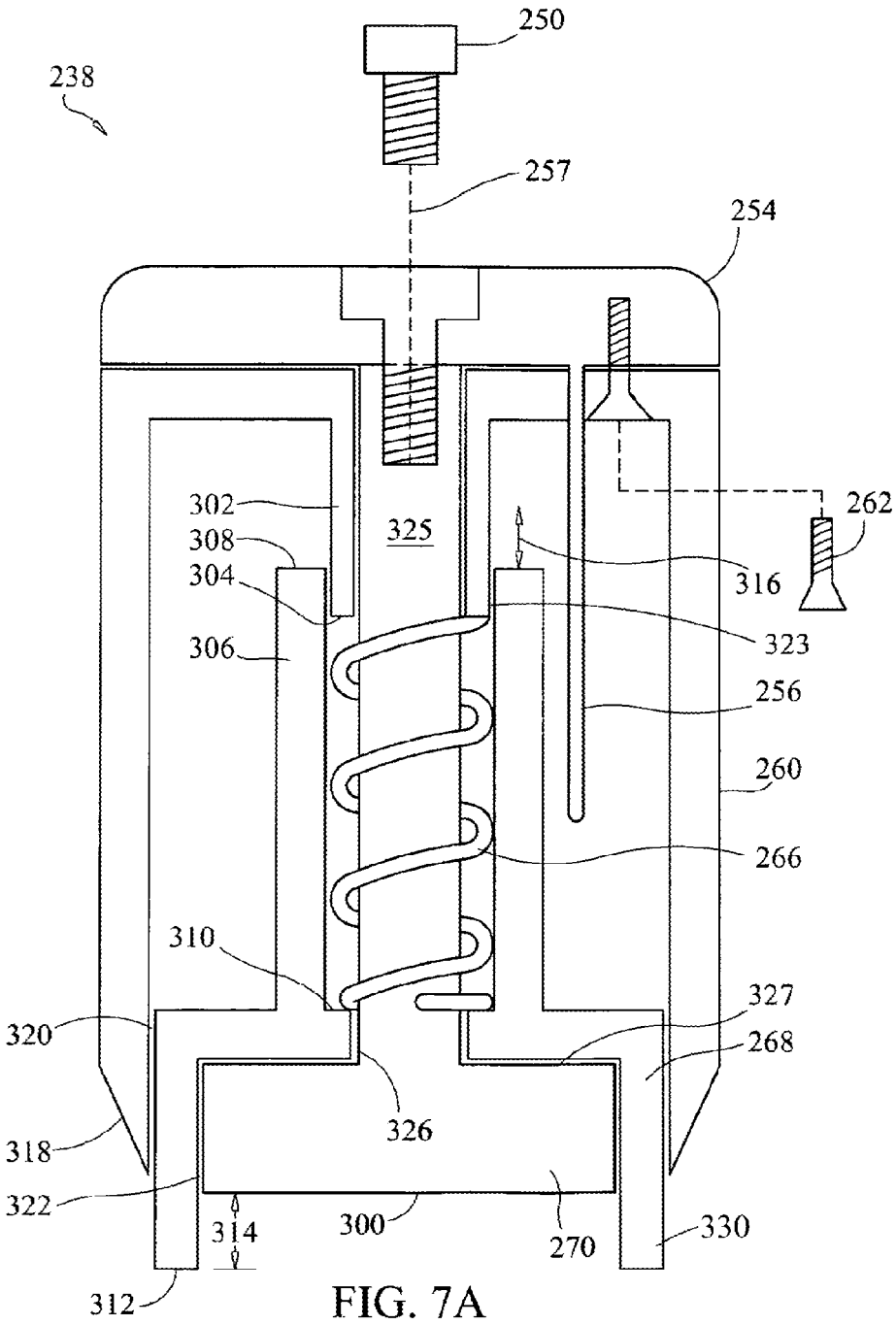
FIG. 7A is a partial cross-sectional view of the bucking bar presented in FIG. 6B (for purposes of clarity, only selected components are presented).

Referring to FIG. 7A, a cross-sectional view of a preferred embodiment bucking bar 238 is presented. In this embodiment, cap bolt fastener 250 is threadedly engaged with end of the shaft of hammer 270 and serves to affix hammer 270 to cap 254. Optionally, this engagement may be augmented with a key (not shown in FIG. 7A) interfacing between the threaded end of the shaft of hammer 270 with cap, serving to allow user to secure fastener 250 without rotating the shaft of hammer 270. A plurality of housing fasteners 262 attach housing 260 to cap 254. Compression spring 266 applies opposing force to distal shoulder 304, located at end of interior cylinder stem 302 of housing 260, and to proximal shoulder 310 of plunger 268.

Movement of plunger 268 is preferably guided by machine slide tolerances at housing and plunger surfaces 320, bounded as shown by housing 260 and plunger 268. Movement of plunger 268 is preferably further guided by machine slide tolerances at hammer and plunger surfaces 322, bounded as shown by the base of hammer 270 and plunger 268. Movement of plunger 268 is preferably further guided by machine slide tolerances at housing cylinder stem and plunger stem at surfaces 323; bounded by cylinder stem 302 and plunger stem 306. Movement of plunger 268 is preferably still further guided by machine slide tolerances at hammer stem and plunger surfaces 326; bounded as shown by hammer stem 325 and plunger 268. In this embodiment, plunger 268 can thus only move parallel to longitudinal axis 257.

Proximal surface 318 of housing 260 is preferably beveled as shown to reduce potential bucker finger pinch-point injuries. In this embodiment, conducting post 256 provides an electrically conductive path from the cavity in housing 260 to the anvil face 300 through cap 254 and hammer 270 (which conductive path is discussed later).

In this embodiment, anvil face 300 becomes orthogonally aligned to work piece 73 and rivet shank end 70 by flush-contact between second facing surface 76 and lip or spindles feet 312 surface, located at the base of plunger 268. Unless a force greater than that exerted by compression spring 266 is axially applied to spindles feet 312, compression spring 266 forces plunger 268 to remain against hammer base 327. When downward force is applied to bucking bar 238 (with spindles feet 312 resting against second facing surface 76), preferably any possible air gap 96 between work pieces 72 and 73 is eliminated by the force exerted by compression spring 266 on second facing work surface 76 through spindles feet 312 of plunger 268.

In this configuration, any axial motion of plunger 268 deflects compression spring 266. However, while spindles feet 312 are in contact with second facing surface 76, a first distance 314 between second facing surface 76 and anvil face 300 is directly transferred to a second distance 316 by displacement of plunger shoulder 308. When enough downward force is applied to the bucking bar 238, anvil face 300 comes in contact with the rivet shank end 70, from this moment forward first distance 314 represents the height of the forming rivet head. First distance 314 and second distance 316 are always equal because first distance 314 is translated through plunger 268 body to second distance 316. Further, the plunger 268 forms a shroud 330 around the hammer 270 and rivet head 86, and thus serves to prevent the bucking bar 238 from sliding off the formed rivet head during rivet driving.

Figure 7B:
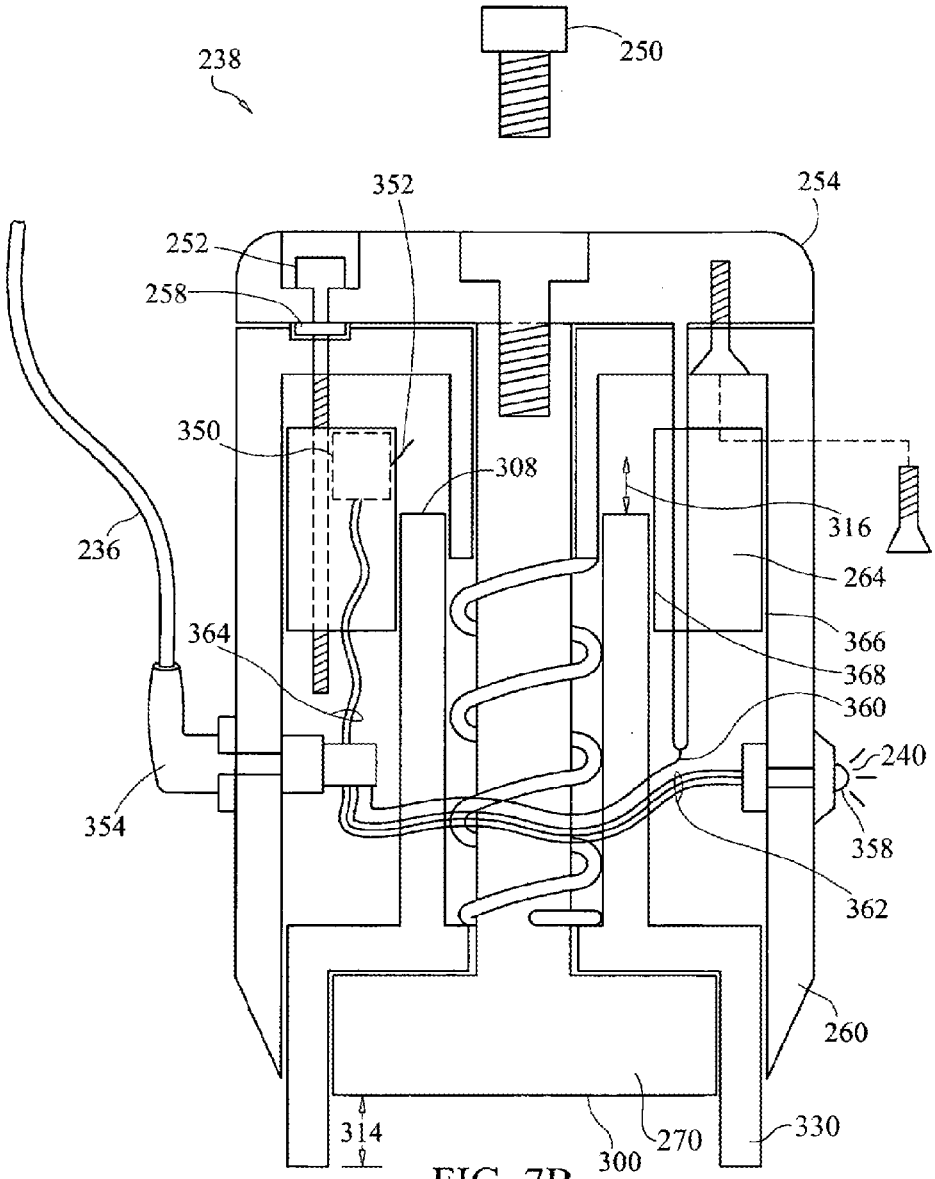
FIG. 7B is a detailed cross-sectional view of the bucking bar presented in FIG. 6B (including parts shown in FIG. 7A).

Referring to FIG. 7B, a partial cross-sectional view of the more preferred embodiment bucking bar 238 of FIG. 7A is presented that provides additional detail. In this embodiment, bucking bar 238 comprises a micro-adjustable jackscrew assembly that includes jackscrew 252 coupled to cap 254 by means of e-spring clip 258. Jackscrew 252 preferably has a small slot in its shaft to accept clip 258 and likewise housing 260 preferably also has a small slot to provide clearance for clip 258. Jackscrew 252 extends through cap 254 and housing 260 and is threadedly engaged with traveling nut 264. Switch 350 is affixed to traveling nut 264 such that switch lever arm 352 may contact shoulder 308 as second distance 316 is translated from first distance 314. Jackscrew 252 is not however threadedly engaged with cap 254, clip 258 or housing 260. This restricts the motion of jackscrew 252 motion to clockwise or counter-clockwise rotational movement which movement is operative to axially position traveling nut 264 and cause switch 350 to trip switch lever 352 on plunger shoulder 308 when desired set rivet head height 84 is achieved.

In this embodiment, movement of traveling nut 264 is preferably guided by machine slide tolerances at housing and traveling nut surfaces 366 and at plunger and traveling nut surfaces 368; bounded as shown by housing 260 and traveling nut 264 and by plunger stem 308 and traveling nut 264, respectively. In an alternate embodiment, traveling nut 264 may be guided by other bodies, for example, by conducting post 256 or a grooved slot in the body of housing 260.

The micro-adjustable jackscrew assembly is preferably calibrated by placing a disk or other body having height matching desired set rivet head height 84 on second facing surface 76 (or another surface that is equivalent to second facing surface 76); then, bucking bar 238 is placed over the disk and compressed until anvil face 300 is flush against the disk and spindles feet 312 are against second facing surface 76. Next, the rivet gun operator contacts set tool 104 against the rivet manufactured head 66 to cause bucking bar indicator LED light 240 to illuminate; finally, the bucking bar operator adjusts jackscrew 252 until the bucking bar indicator LED light 240 begins to continuously flash on and off. This is a simple one-point calibration. Some sensors require that the user be cognizant of switch behavior such as pre-travel, otherwise known as the movement of the actuator prior to closing the circuit, sometimes referred to as "Travel to Make." Another switch behavior is hysteresis described here as a "Travel to Break." Thus the switch make and switch break positions do not always coincide. Those skilled in the art will recognize that employing a second switch in bucking bar 238 having switch lever axially offset from the first rivet set threshold (height 86 tolerance detection) switch can also be used to overcome these problems; provided that the offset distance is sufficient for the second switch to make after the first switch breaks. Other calibration methods may be used without out deviation from concept of this invention. A user operated switch can optionally invoke the calibration process (presented later).

Bucking bar 238 preferably further comprises second multi-conductor cable 236 having a jack-plug assembly 354. From jack-plug assembly 354, first internal wire 360 is coupled to conducting post 256. Also from jack-plug assembly 354, second internal wires 364 connect to switch 350 and third internal wires 362 connect to momentary push-button switch and indicator LED light assembly 358.

In this embodiment, bucking bar indicator LED light 240 shown in other embodiments is intentionally replaced by a combination comprising momentary push-button switch and indicator LED light assembly 358. Momentary push-button switch and indicator LED light assembly 358 provides the bucker with the option of manually indicating when he is "ready" to begin bucking. This feature is considered an alternate embodiment because, in some cases, rivets are coated with a non-conductive material. This alternate embodiment also includes a momentary push-button switch (not shown) on circuit board 212 (shown in other embodiments) that also provides the rivet gun operator with the option of manually indicating when he is "ready" to begin riveting.

Figure 8:
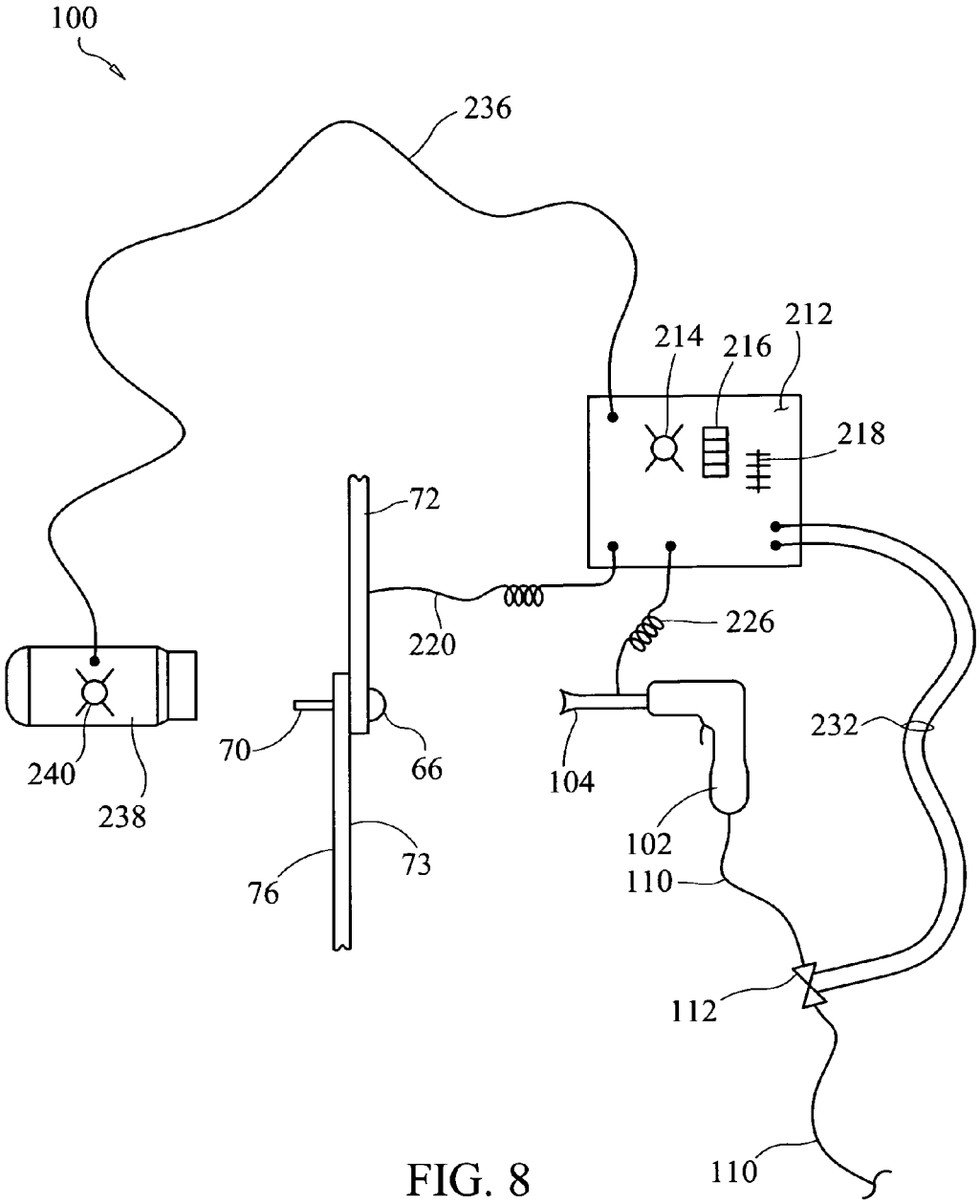
FIG. 8 is a schematic diagram of a more preferred embodiment of the invention, exhibiting general components and their relationships.

Referring to FIG. 8, a more preferred embodiment of the invention is presented that preferably incorporates bucking bar 238. In this embodiment, rivet fastening system 100 is comprised of pneumatic rivet gun 102 that is equipped with rivet set tool 104 and circuit board 212. Circuit board 212 preferably comprises mounted LED indicator light 214, mounted LED indicator light bar 216, a set of user selectable position switches 218, first conducting lead wire 220 and second conducting lead wire 226, first multi-conductor cable 232 and second multi-conductor cable 236 and various electronic components such as a circuit isolating photocoupler, a microprocessor, a battery and/or an external power supply, a power regulator, and a communication port (with these electronic components not being shown in FIG. 8 for purposes of clarity). Second multi-conductor cable 236 preferably couples circuit board 212 to the bucking bar 238. The equipment shown in FIG. 8 better accommodates the functionality described earlier with respect to equipment shown in FIGS. 5A and 5B and allows for additional capabilities to be presented later.

Contacting set tool 104 with rivet manufactured head 66 and/or first work piece 72 closes a first circuit loop formed by first conducting lead wire 220 and second conducting lead wire 226. Upon detection of this first completed circuit, the computer illuminates mounted LED indicator light 214 and bucking bar indicator LED light 240 located on circuit board 212 and bucking bar 238, respectively; this indicates to both operators that the rivet gun operator is "ready" to begin riveting. In an alternate embodiment, first conducting lead wire 220 is replaced with a touch capacitance sensor mounted on circuit board 212 that is coupled to second conducting lead wire 226 to sense contact between set tool 104 and manufactured head 66.

When bucking bar indicator LED light 240 illuminates, the bucker then backs up rivet shank end 70 with bucking bar 238. This action compresses plunger 268 which applies force to second work piece 73 to eliminate any air gap 96. Plunger 268 is further compressed until anvil face 300 of bucking bar 238 contacts rivet shank end 70 forming a second circuit loop through a first path (second conducting lead wire 226, set tool 104, manufactured head 66 and/or first work piece 72, the bucking bar anvil, and second multi-conductor cable 236) or alternately through a second path (first conducting lead wire 220, first work piece 72, common rivet 62, the bucking bar anvil, and cable 236). Upon detecting this second circuit the computer continuously flashes indicator LED lights 214 and 240 on-and-off to indicate to both operators that the bucker is also "ready" to begin riveting. Furthermore, the computer also then opens solenoid valve 112 to enable operation of rivet gun 102.

While common rivet 62 is being driven, rivet head 86 forms until it meets the desired rivet head height 84. Also, while common rivet 62 is being driven, plunger 268, acting against second facing surface 76 is further compressed. Upon achieving the desired head height 84, a switch is toggled by the axial motion of plunger 268; this forms a third circuit loop using at least two conductor wires in second multi-conductor cable 236. When this third circuit is detected, the computer turns off mounted LED indicator light 214 and bucking bar indicator LED light 240 and closes solenoid valve 112 to disable rivet gun 102, thereby stopping rivet gun 102. Mounted LED indicator light 214 and bucking bar indicator LED light 240 being turned off as well rivet gun 102 being disabled, serves to indicate to both operators that the rivet has been set. A timing delay is then started by the microprocessor before enabling a new riveting cycle. In this way, the computer sequentially controls each stage of the rivet setting cycle. This sequencing prevents, for example, the bucker from indicating the he is "ready" until after the rivet gun operator has indicated that he is "ready."

In an alternative embodiment, detection of a closed circuit when set tool 104 contacts rivet head 66 may be achieved by detecting a loop circuit formed by first conducting lead wire 220 and second conducting lead wire 226 at circuit board 212. Similarly, a circuit loop is completed at circuit board 212 when both (1) set tool 104 contacts rivet manufactured head 66 and (2) anvil face 300 contacts rivet shank end 70 forming a contact circuit through second conducting lead wire 226 and second multi-conductor cable 236. Detection of these circuit loops can be achieved by any means including measuring conductivity or electrical resistance in the loop to determine if the circuit of interest is open or closed, and/or detecting an applied voltage from one side of the circuit loop with a microprocessor.

In an alternate embodiment, second multi-conductor cable 236 is replaced by radio frequency (RF) communication. In this embodiment, bucking bar 238 is provided with a separate circuit board, with both the circuit board 212 and the separate circuit board being equipped with RF transceivers for purposes of wireless communication. In this alternate embodiment, another conducting lead wire may extend from bucking bar 238 to work piece 72 or 73 that would be closed when anvil face 300 contacts rivet shank end 70. In still another alternate embodiment, wires first conducting lead wire 220 and the other conducting lead wire described above may be instrumented by installing capacitance sensors at circuit board 212 and at the separate circuit board described above for detecting contact of set tool 104 or anvil face 300 with rivet 62. Any other contact detector method or sensing technology may be incorporated into the invention without deviation from the inventive concept.

Figure 9:
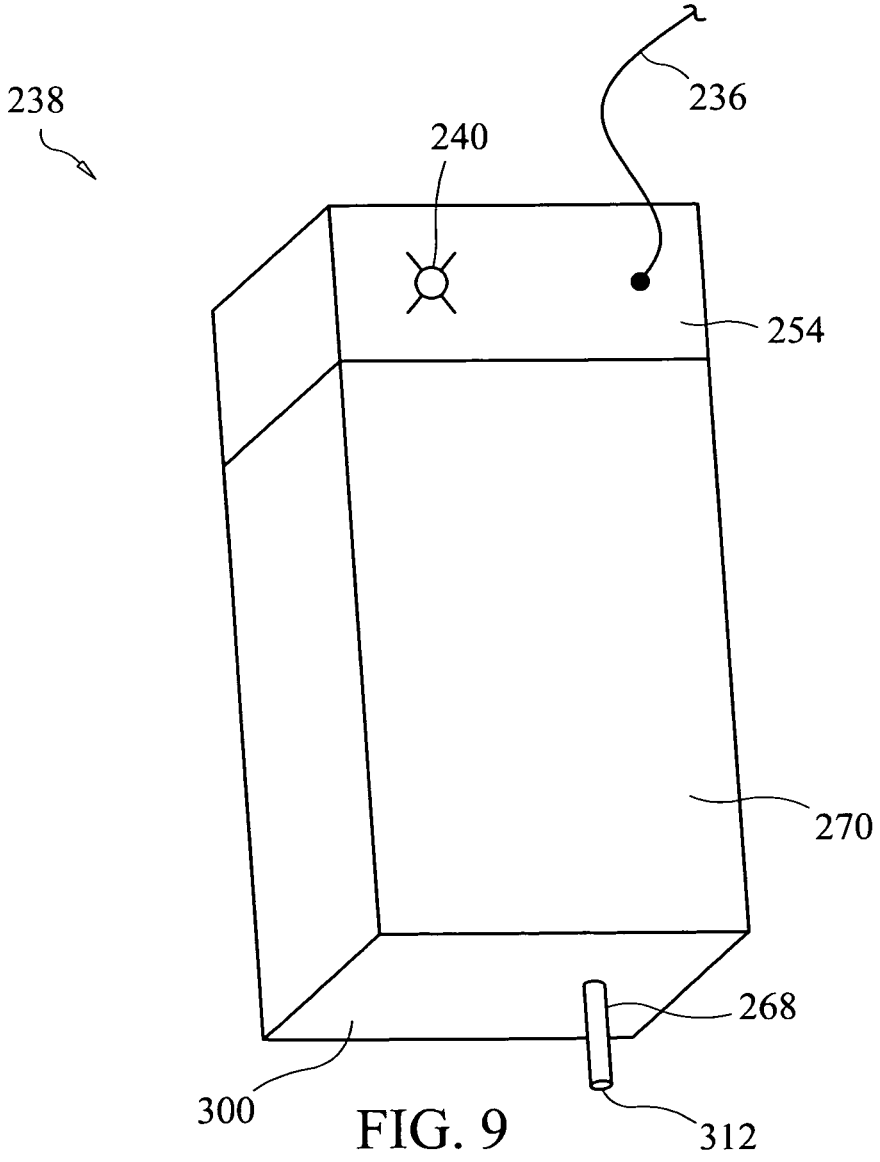
FIG. 9 is a perspective view of an alternate embodiment of the bucking bar of the invention.

Referring to FIG. 9, a perspective view of an alternate embodiment of bucking bar 238 is presented. A person having ordinary skill in the art will understand that the configuration presented in FIG. 7B may be modified in any way to adapt the described bucking bar 238 to specific riveting applications (this is the reason for multiple configurations of conventional bucking bars shown in FIGS. 1A-1D). However, it is acknowledged that, in some cases, riveting in extremely congested areas may limit the use of a preferred embodiment bucking bar 238. In these cases, use of the alternate embodiment of bucking bar 238 shown in FIG. 9 may be appropriate. The alternative embodiment of bucking bar 238 of FIG. 9 differs from the preferred embodiment of bucking bar 238 of FIG. 7B in that plunger 268 preferably comprises a stem (spindles feet 312) that extends through bucking hammer 270 and beyond anvil face 300. In this embodiment, cap 254 houses all other components previously described and those skilled in the art would appreciate design considerations needed for construction of the alternative embodiment, given the teachings of this disclosure. The alternative embodiment of bucking bar 238 shown in FIG. 9 is preferably functionally the same as the preferred embodiment of bucking bar 238 shown in FIG. 7B except that spindles feet 312 in the alternative embodiment do not shroud the rivet head, preventing bucking bar 238 from slipping off a forming rivet head.

Figure 10:
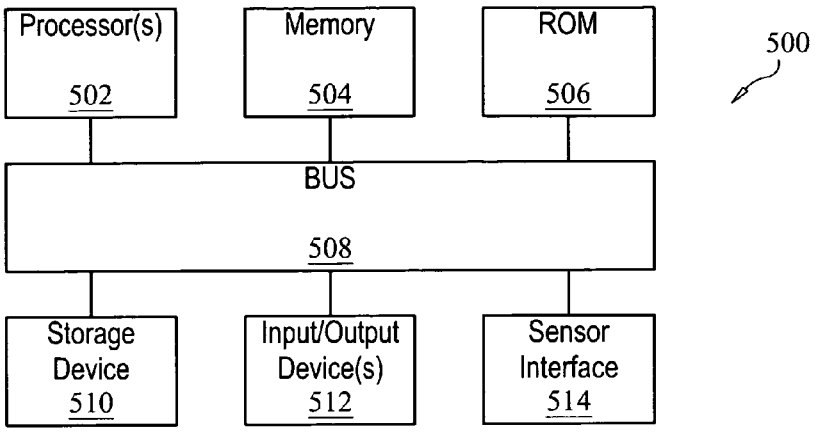
FIG. 10 is a schematic block diagram of a computer in accordance with a preferred embodiment of the invention.

Referring to FIG. 10, a block diagram of a preferred embodiment of bucking bar controller 500 is presented. In this embodiment, bucking bar controller 500 comprises bus 508 or another communication device to communicate information, and processor 502 coupled to bus 508 to process information. While bucking bar controller 500 is illustrated in FIG. 10 as having a single processor, bucking bar controller 500 may include multiple processors and/or co-processors. Bucking bar controller 500 preferably further comprises random access memory (RAM) 504 and/or another dynamic storage device 510 (also referred to herein as memory), coupled to bus 508 to store information and instructions to be executed by processor 502. Random access memory 504 may also be provided to store temporary variables or other intermediate information during execution of instructions by processor 502.

Bucking bar controller 500 may also comprise read only memory 506 (ROM) and/or another static storage device coupled to bus 508 to store static information and instructions for processor 502. Data storage device 510 is preferably coupled to bus 508 to store information and instructions. Input/output device(s) 512 may include any device known in the art to provide input data to a controller such as bucking bar controller 500 and/or receive output data from a controller such as bucking bar controller 500.

In preferred embodiments, instructions are provided to memory 504 from a conventional storage device, such as a magnetic disk, Electrically Erasable Program Memory (EEPROM), read-only memory (ROM) integrated circuit, CD-ROM, DVD, via a remote connection that is either wired or wireless, providing access to one or more electronically-accessible media, etc. In alternative embodiments, hard-wired circuitry can be used in place of or in combination with software instructions. Thus, means for execution of sequences of instructions in accordance with the invention are not limited to any specific combination of hardware circuitry and software instructions.

In a preferred embodiment, sensor interface 514 allows bucking bar controller 500 to communicate with one or more sensors within rivet fastening system 100. For example, sensor interface 514 may be configured to receive output signals from one or more switches that detect switch states of the components of rivet fastening system 100 as described herein. Sensor interface 514 may be, for example, an analog-to-digital converter that converts an analog voltage signal generated by a LVDT sensor to a multi-bit digital signal for use by processor 502.

In a preferred embodiment, processor 502 analyzes sensor input data and transmits signal to indicator lights, graphical user interfaces (GUIs) such as LCDs through input/output device(s) 512 to allow communication between operators or to allow operator calibration of bucking bar 238. Additionally, in an alternate embodiment, second multi-conductor cable 236 is replaced by radio frequency signals. In this configuration, each of at least two controllers 500 may be coupled to radio frequency transceivers to communicate signals characterizing the state of the rivet driving process between the rivet gun operator and the bucker as described in this disclosure.

Processor(s) 502 may also cause system components to take other actions in response to signals from the sensors. For example, processor(s) 502 may cause solenoid valve 112 to open or close thus enabling or disabling rivet gun 102.

Figure 11:
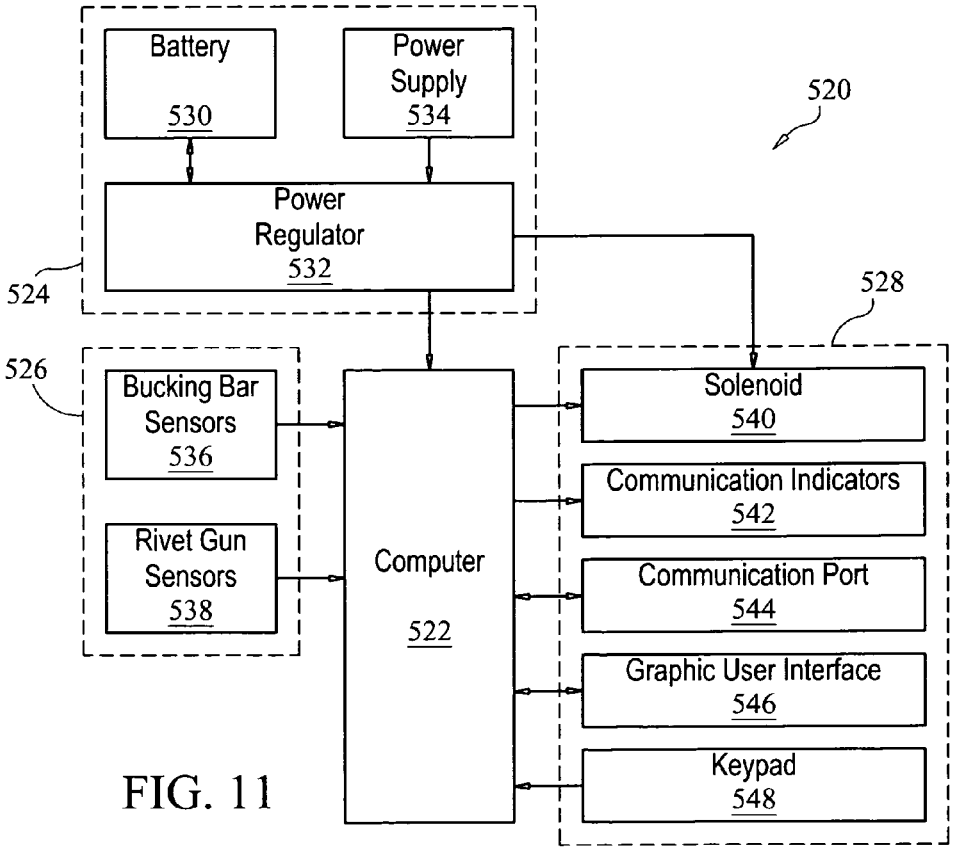
FIG. 11 is a schematic block diagram of a control system in accordance with a preferred embodiment of the invention comprising the computer illustrated in FIG. 10 interconnected with computer peripherals.

Referring to FIG. 11, a schematic block diagram of bucking bar control system 520 is presented. In this embodiment, bucking bar control system 520 comprises computer 522 for acquiring and processing data relating to the rivet driving cycle or process. Preferably, control system 520 includes power subsystem 524, sensor array subsystem 526, and control and communication subsystem 528. Power subsystem 524 preferably includes rechargeable battery 530 for powering bucking bar control system 520, and power regulator 532 for power control and recharging battery 530. External power supply 534 may be used to supply charging power or optionally to replace the battery 530. Power from regulator 532 is supplied to computer 522 and (optionally) to solenoid 540 and (optionally) may facilitate supplying power to other components of bucking bar control system 520.

In this embodiment, sensor array subsystem 526 includes bucking bar sensors 536 and rivet gun sensors 538. Control and communication subsystem 528 preferably includes a pneumatic solenoid 540 also having a driver relay, communication indicator(s) 542, such as LEDs and or LED lightbars, communication port 544 for down loading data logged recordings of set rivet head heights for process quality assurance/quality control purposes (which may optionally include at least one of radio frequency (RF) transmitter, receiver and transceiver), graphical user interface (GUI) 546 for operator interfacing with bucking bar control system 520 and keypad 548 also for operator interfacing with bucking bar control system 520.

In operation of preferred embodiments of the invention, data generated by each of the components of sensor array subsystem 526 are transmitted to computer 522 where the data are processed and stored. Bucking bar system control commands are preferably then transmitted to control and communication subsystem 528 where solenoid operation is determined, communication of rivet cycle stage is indicated, user interface is achieved and data-logged rivet head setting data are transmitted to other media via a transceiver or by other means.

Figure 12:
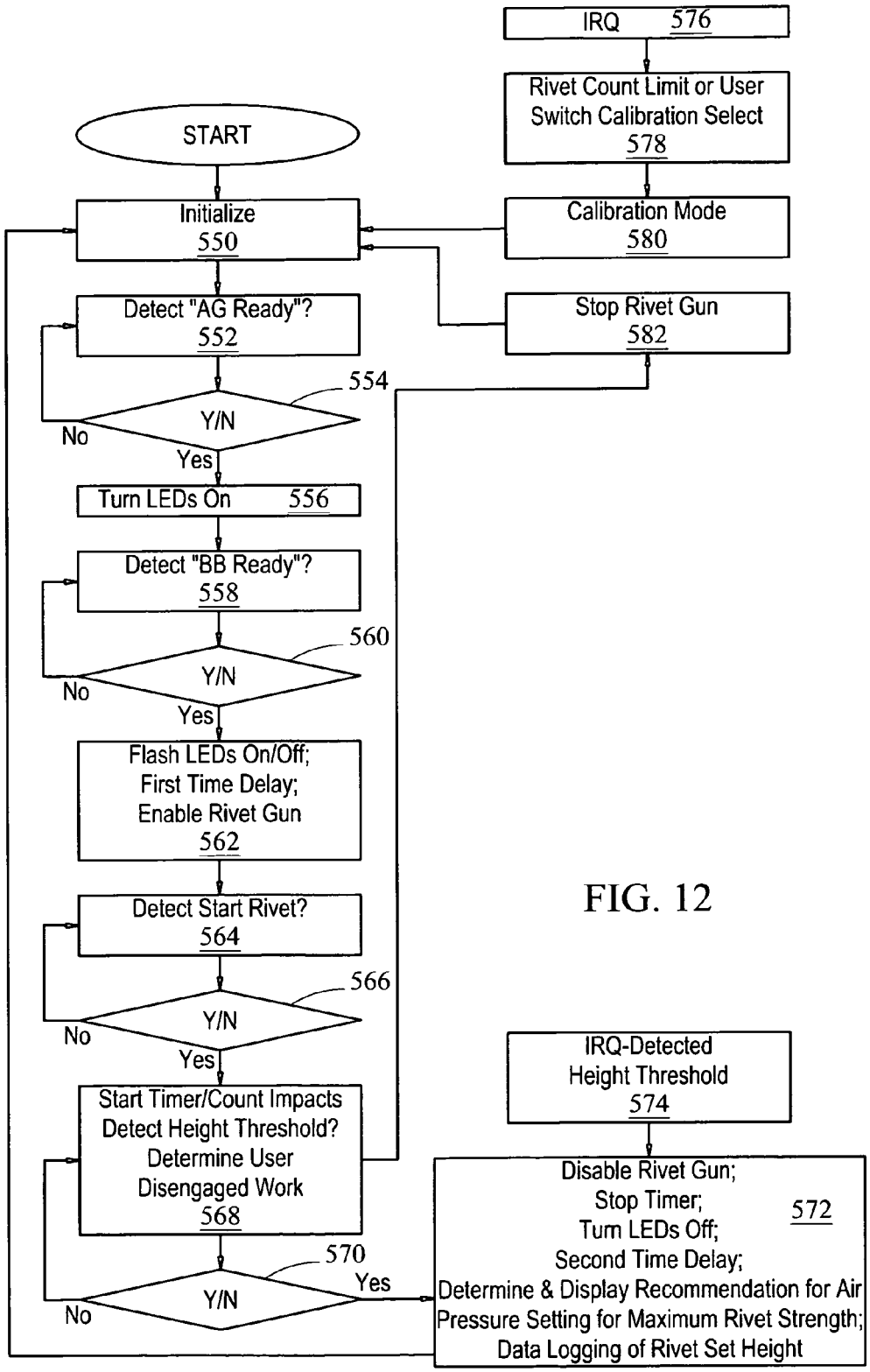
FIG. 12 is a schematic process flow diagram for a computer program or software listing in accordance with a preferred embodiment of the invention.

Referring to FIG. 12, a schematic flow diagram of a preferred embodiment of bucking bar controller software instructions is presented. In this embodiment, because controller 500 governs sequential riveting steps, when rivet fastening system 100 is started, controller 500 immediately initializes system components in initialize step 550 by setting variables, inputs and outputs, and setting the solenoid to disable the rivet gun.

Next, in this embodiment, controller 500 preferably waits for a received sensor signal to indicate that the rivet-gun operator is "ready" in detect "AG Ready" step 552; in gun ready conditional step 554 forces the sequencing process. Next, a rivet driving cycle is begun when controller 500 detects an affirmative signal from gun ready conditional step 554; controller 500 then responds by illuminating rivet gun operator and bucker indicator lights to turn LEDs on in step 556 to indicate to both operators that the rivet gun operator is ready to begin riveting.

Next, in this embodiment, controller 500 waits for a received sensor signal to indicate that the bucker is "ready" in detect "BB Ready" step 558; bucker ready conditional step 560 forces the sequencing process. When controller 500 detects an affirmative signal from bucker ready conditional step 560, it continuously flashes both indicator lights on-and-off, preferably starts an optional first time delay to provide the operators a final moment before riveting begins and then enables the rivet gun to initiate riveting step 562. The flashing lights indicate to both operators that the bucker is "ready" to begin riveting. In an alternate embodiment, controller 500 may automatically start the rivet gun to eliminate the need for the rivet-gun operator to depress the rivet-gun trigger.

Next, in this embodiment, controller 500 waits to receive a sensor signal to indicate that the riveting has begun in detect start rivet step 564; rivet start conditional step 566 forces the sequencing process. When an affirmative signal is detected in rivet start conditional step 566, controller 500 starts a timer and counts the number of impact blows from rivet gun 102 while simultaneously waiting to receive a rivet head height threshold detection in start timer/count impacts step 568; detect height threshold conditional step 570 forces the sequencing process. A limit threshold sensor is preferably used to detect when the height of the rivet's desired set rivet head height 84 is reached in the driving process. Thus, while waiting for an affirmative detection signal in detect height threshold conditional step 570, controller 500 counts the number of rivet-gun impacts by the number of toggled switch states of the bucking bar anvil face 300 contacting rivet shank end (upon each impact the bucking bar anvil face 300 is bounced off the rivet head forming a switching cycle; and in preferred embodiments controller 500 "debounces" the signal to match typical rivet-gun operating frequencies). In an alternate embodiment, a sensor such as an accelerometer is used to detect rivet gun blows or impacts.

Also incorporated in step 568 is an interrupt service request (IRQ) that activates if either the bucker or the rivet gun operator disengages the work during the rivet driving stage. The IRQ in step 568 stops the rivet gun in step 582 conducts a time delay and returns control to step 550. This is particularly important because if the bucker were to disengage the bucking bar from the rivet during the rivet driving stage then hammer blows from the rivet gun would then damage the work. The described bucker "ready" detection sensor is preferably used to detect bucking bar disengagement during the driving stage and preferably stop the rivet gun immediately to prevent any hammer blows to work that is not backed by the bucking bar. [More details of this feature are presented later].

In this embodiment, after detecting an affirmative signal in detect height threshold conditional step 570, then in step 572 controller 500 disables rivet gun 102: stopping rivet gun 102, stops the timer started in start timer/count impacts step 568, turns off the indicator lights and starts a second user selectable time delay. The second time delay allows the rivet gun operator to remove rivet gun 102 from the work prior to start the next rivet cycle. Meanwhile, controller 500 then preferably determines rivet strength according to stress-strain curves using the previous setting time and number of hammer blows measured in start timer/count impacts step 568 and then displays recommended rivet gun air-pressure setting modifications to the rivet gun operator who may then adjust the impacting force (regulated air pressure setting) supplied to rivet gun 102. In an alternate embodiment, controller 500 makes rivet-gun air-pressure setting changes automatically through feedback control of an electro-mechanical air regulator (not shown).

Finally, after the completion of the time delay set in end riveting step 572, the rivet driving cycle is completed and controller 500 returns to initialize step 550, although display results generated in end riveting cycle step 572 are not cleared from the display until an affirmative signal is detected at ready gun conditional step 554 in the next rivet setting cycle. This allows the rivet gun operator additional time between rivet cycles to adjust rivet gun regulated air pressure settings. If at any time the desired set rivet head height threshold is detected, an interrupt service request in first interrupt service request step 574 forces operation to reset to end riveting cycle step 572. IRQ in step 574 serves as software redundancy to rivet head height detection in step 568.

Referring again to FIG. 12, still another interrupt service request (IRQ) is preferably provided in second interrupt service request step 576 upon detection of the user's toggling a switch to manually enter a calibration mode or, optionally, if the total number of rivets exceeds a predetermined number since the last time a calibration was conducted, a forced calibration is initiated in step 578 (control system 500 preferably counts the number of rivets driven by counting the number of rivet cycles in step 572). In calibration mode step 580, the user calibrates the bucking bar to set the rivet head height detection threshold to achieve setting rivets to a desired optimal tolerance. After calibration mode in step 580, operation is returned to step 550.

During the rivet driving stage, the circuit detecting contact between anvil face 300 and rivet shank end 70 exhibits a significant amount of switch chatter 371 (rapid opening and closing of contacts) indicative of extreme vibration and/or shock. However by coupling at least one of a hardware and a software low-pass filter to this circuit, the rivet gun hammering cycle can be identified. This information may be then used to automatically determine if the bucker inadvertently disengaged bucking bar 238 anvil face 300 from rivet shank 70 during the rivet driving stage and would then produce a software interrupt service request to immediately stop the rivet gun. Bucking bar removal from work during the rivet driving stage can be detected automatically regardless of the many variables presented earlier (such as variations in bucking bar mass, rivet gun mass, applied user forces, air pressure settings, etc.). The benefit of detecting bar disengagement during the driving stage is protection to the work from hammering on work that is not backed by a bucking bar. In this case bucking bar disengagement or removal is defined as removing the bucking bar anvil face 300 from rivet shank 70 to stop backing the rivet; it is not a result of anvil face 300 being momentarily "bucked" off the shank 70 as a result of the normal rivet driving stage cycle.

Furthermore, while adding a dampener was considered by the applicant as a way to further stabilize the bucking bar, users prefer a bucking bar that allows them to "feel" the work. However, adding a dampener in an alternate embodiment is envisioned by the applicant.

In summary, a low pass filter can be used to "debounce" signals to accommodate for mechanical and/or electrical bouncing of the bucking bar anvil face 300 on the forming rivet head. These data may be used to prevent inadvertent damage to the work by hammering on unbacked work by disabling the rivet gun, if either operator disengages their tool from the work during the rivet driving stage. Optionally, by determining the hammer period and identifying each falling-edge-signal, system 100 may determine that the anvil face 300 is in contact with rivet shank end 70 just before the rivet gun "hammers" again (or just before a few milliseconds more than it takes to disengage the rivet gun before the next "hammer" commences).

Figure 13:
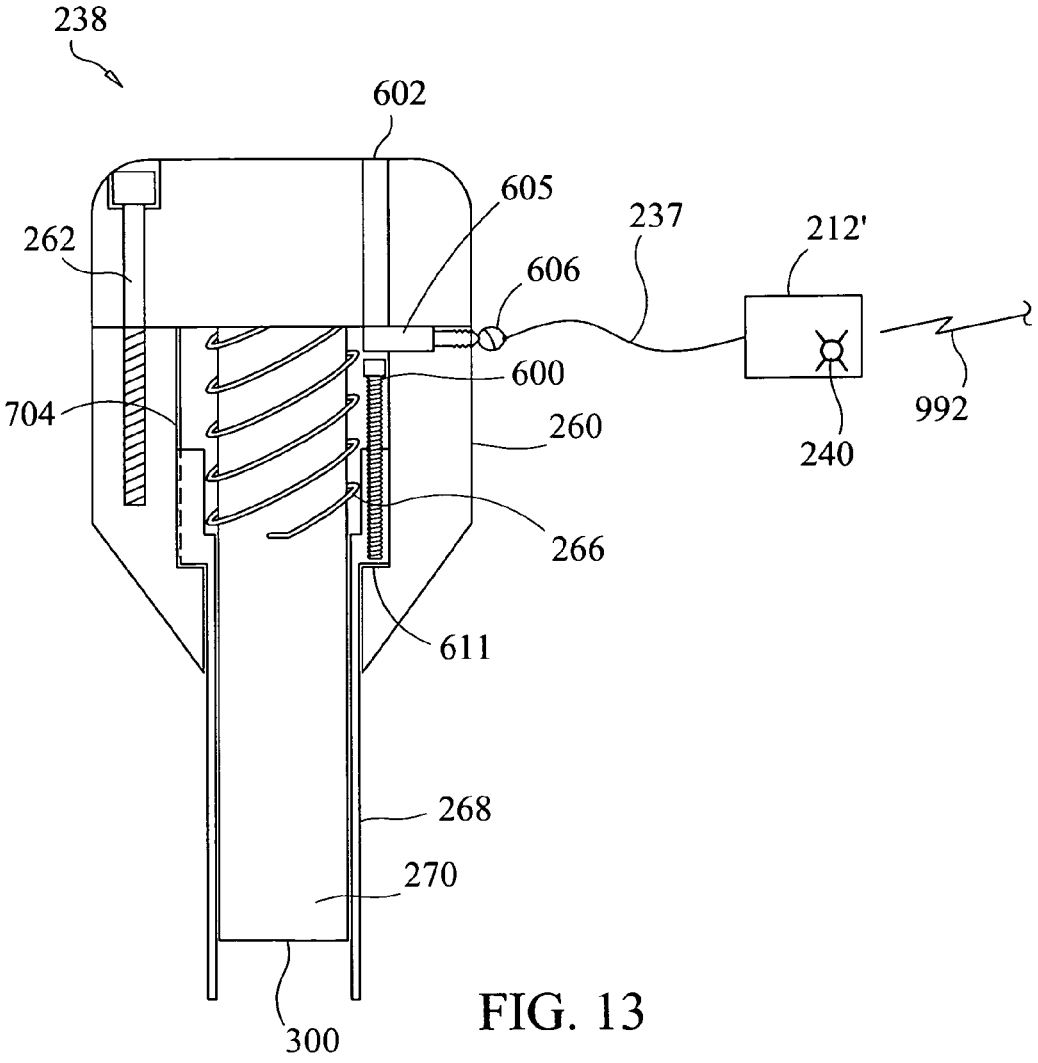
FIG. 13 is a cross-sectional view of yet another alternate embodiment of a bucking bar in accordance with the invention.

Referring to FIG. 13, a partial cross-sectional view of still another alternate embodiment of bucking bar 238 is presented to further illustrate another possible configuration. This embodiment combines a cap portion and an anvil portion to form hammer 270 having a reduced diameter anvil face 300. Compression spring 266 applies force to plunger 268 which is retained by housing 260 at housing shoulder 611. Plunger 268 is guided by a groove, key or axially-positioned tab 704 in housing 260 restricting plunger motion to axial travel. Housing 260 is secured to hammer 270 by a plurality of housing bolt fasteners 262.

In this embodiment, a slotted photo switch 605 is preferably retained in a cavity in housing 260 by the shape of said cavity and adhesive. Cap screw 600 is threadedly engaged with threaded plunger 268 as shown to allow axial micro-positioning and adjustment of photo switch 605 operation during calibration process by adjusting cap screw 600 (discussed later). Photo switch 605 toggles switch state when interrupted by the head of cap screw 600. Thus cap screw 600 serves as a mechanical flag to interrupt photo switch 605. Access port 602 allows the user to adjust by rotation of cap screw 600 either clockwise or counterclockwise to axially position cap screw 600 to a desired location.

Upon assembly of this embodiment of bucking bar 238, slotted photo switch 605 is secured to housing 260 with photo switch 605 connected to multi-conductor cable 237 with cable being secured by strain relief device 606 which is preferably threadedly attached with body of housing 260 to support multi-conductor cable 237. Next, compression spring 266, plunger 268 (with pre-installed cap screw 600) and housing 260 are sequentially installed. These components are all held by housing 260 and housing 260 is then affixed to cap end of hammer 270 by housing bolt fasteners 262. A plurality of bolt fasteners 262 are threadedly engaged with the body of housing 260. Multi-conductor cable 237 is coupled to bucker control circuit board 212' upon which is mounted bucking bar indicator LED light 240. Bucker control circuit board 212' preferably communicates with rivet gun control circuit board 212 via radio frequency signals 992. Bucker control circuit board 212' may be affixed to the bucker's wrist by means of a Velcro® fastener, affixed to bucking bar 238 or integrated into bucking bar 238.

In operation, the bucker calibrates bucker bar 238 by setting plunger 268 spindles feet to desired set rivet head height 84 relative to anvil face 300 and then adjusting cap screw 600 until photo switch 605 toggles; a successful calibration is indicated by threshold illumination of bucking bar indicator LED light 240. It is noted in this configuration that during calibration a cap screw adjustment tool (not shown in FIG. 13) will give false detection indication at LED 240 and therefore adjustment tool must be repeatedly removed from slot 602 after having made fine adjustments to the cap screw 600 axial position until desired set rivet head height 84 is detected by interruption of photo switch 605 by head of cap screw 600.

Figure 14:
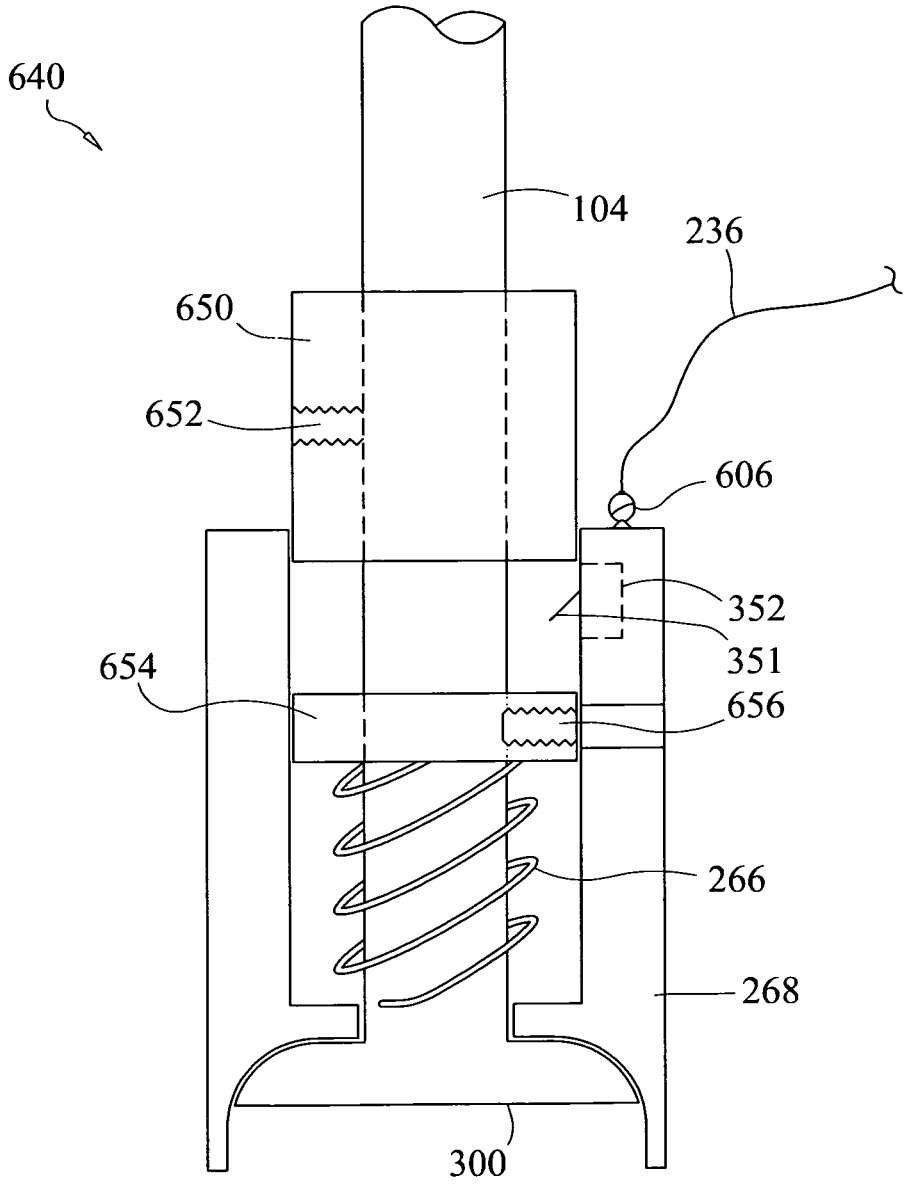
FIG. 14 is a cross-sectional view of yet another alternate embodiment of the invention by applying the electromechanical components previously illustrated in FIGS. 7A and 7B.

Referring to FIG. 14, a partial cross-sectional view of still another alternate embodiment of the invention is presented. In this alternate embodiment the teaching of this invention are applied to the rivet set tool for use in backriveting. Backriveting system 640 is preferably used in situations where a conventional bucking bar is placed over the manufactured head of flush rivet 64 and the rivet gun set tool is used to form driven rivet head 86.

In this embodiment, backriveting system 640 comprises rivet set tool 104 having anvil face 300. Compression spring 266 is retained by internal collar 654 and setscrew 656. Compression spring 266 applies force to plunger 268. An access port through plunger 268 allows setscrew 656 to be tightened into a recess in set tool 104. Set screw 656 is threadedly engaged with collar 654. Embedded in plunger 268 is microswitch 352 having switch lever arm 351 which actuates on the shoulder of external collar 650 which is secured to set tool 104 by external setscrew 652. Set screw 652 is threadedly engaged with collar 650.

During assembly, plunger 268, compression spring 266 and collars 654 and 650 are slid onto set tool 104. External collar 650 is used to position internal collar 654 and compress spring 266 until internal setscrew 656 is fastened. This secures plunger 268 on set tool 104. Next, plunger 268 is positioned to desired set rivet head height 84 and external collar 650 is then positioned such that it just toggles switch lever arm 351 when external collar 650 is secured to set tool 104 with external setscrew 652. Actuation of microswitch 351 is indicated by illumination of an LED and/or solenoid closure that is not shown on FIG. 14 when gap height 314 or the distance between spindles feet and anvil face 300 achieve desired driven rivet head height 84. It is further noted that although a small timing delay may be preferred, system 640 may alternately be used in wireless (RF) applications as a detector for detecting when the set tool contacts a manufactured head to detect (by toggling switch 351 with a small motion of plunger 268) when the rivet gun operator is "ready" to begin riveting. (This is another example of how one could eliminate the need for conducting wire 220 shown in FIG. 8).

Figure 15:
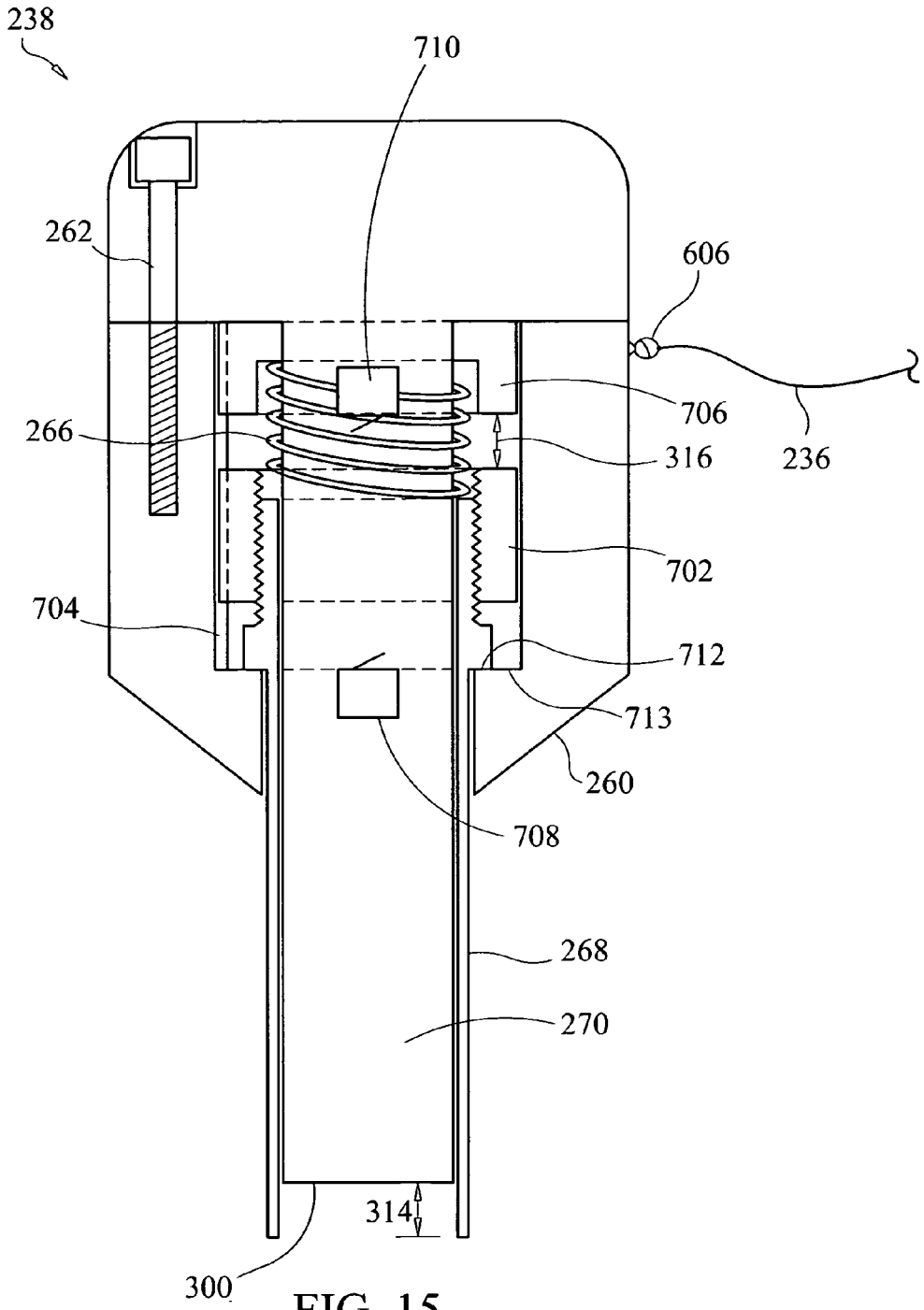
FIG. 15 is a cross-sectional view of still another alternate embodiment of the bucking bar illustrated in FIGS. 7A and 7B.

Referring to FIG. 15, a partial cross-sectional view of still another alternate embodiment of the invention is presented. In this embodiment, bucking bar 238 comprises a micro adjustable system (operated by manual rotation of plunger 268) and further comprises first switch 708 to detect the initial motion of plunger 268 for the purpose of detecting when the bucker is ready. This embodiment is particularly useful in a RF system in which circuit closure cannot be detected by means of a circuit on the rivet gun side. It should be noted that the embodiment in FIG. 15 could be further simplified by removing collar 706 and embedding second switch 710 into sidewall of housing 260 or embedding second switch 710 into cap end of hammer while maintaining the same functionality.

Similar to the embodiment shown in FIG. 13, the embodiment of bucking bar 238 shown in FIG. 15 combines the cap and anvil to form hammer 270 having a reduced-diameter anvil face 300. Compression spring 266 applies force to plunger 268 which is retained by housing 260. Housing 260 is secured to hammer 270 by a plurality of housing bolt fasteners 262.

In this embodiment, plunger 268 is preferably retained in housing 260 by the shoulder of plunger collar 712 on shoulder of housing 713 while plunger 268 is threadedly engaged with threaded traveling nut 702. Threaded traveling nut 702 is preferably guided by a groove, key or axially-positioned tab 704 in housing 260. Tab 704 thus prevents rotational motion of threaded traveling nut 702, thereby restricting traveling nut 702 to axial movements. This configuration allows the user to rotate plunger 268 clockwise or counterclockwise relative to housing 260 by grasping it at its exposed end (near anvil face 300), to position threaded traveling nut 702 within housing 260 cavity. The threaded engagement between plunger 268 and threaded traveling nut 702 provides sufficient friction to prevent inadvertent rotation of plunger 268 and guide marks (not shown) on the outside of plunger 268 may be aligned with similar guide marks (also not shown) on the outside of housing 260 for position referencing of threaded traveling nut 702. (All threaded engagements described in this disclosure are preferably provided with sufficient friction to prevention inadvertent or unintended movement or rotation.)

In this embodiment, first embedded switch 708 is embedded in housing 260 and when plunger 268 is not deflected by first distance 314, the shoulder of plunger collar 712 holds the switch actuation lever down due to the force exerted by compression spring 266. Thus, with only a slight axial movement of plunger 268, a switch state change is detected at first embedded switch 708 as collar 712 of plunger 268 moves off of the switch actuation lever. This detection feature, combined with a small timing delay in a microprocessor, may be used to detect when the bucker has indicated that he is "ready" to begin bucking.

In this embodiment, second embedded switch 710 is embedded into cylindrically-shaped switch housing collar 706. Compression spring 266 fits into a recess in switch housing collar 706 and securely maintains switch housing collar 706 firmly against the cap of hammer 270. Collar 706 is also engaged with tab 704 to prevent collar 706 rotation relative to hammer 270 shaft. Second switch 710 is also located near the outside diameter of switch housing collar 706. In this configuration, displacement of plunger 268 by distance 314 is translated into distance 316 by the shoulder of threaded traveling nut 702, but threaded traveling nut 702 is limited in travel by contact with switch housing collar 706. However, slightly before threaded traveling nut 702 abuts the shoulder of switch housing collar 706, the shoulder threaded traveling nut 702 actuates the switch lever of second embedded switch 710, resulting in a switch state change. This switch state change is detected at second embedded switch 710 and indicates that the desired set rivet head height 84 has been achieved.

It is noted that a second compression spring (not shown) could be affixed to second embedded switch 710 to allow plunger 268 to move distance 314, causing the end of traveling nut 702 to press against second switch 710 and thereby causing the state of switch 710 to toggle. Should traveling nut 702 rapidly impact against second switch 710, the second compression spring would then compress allowing second switch 710 to recess into a receiving slot in switch housing collar 706, thereby protecting second switch 710. Furthermore, plunger travel 314 is allowed to travel until flush with (and preferably slightly beyond) anvil face 300 before limiting the travel of the shoulder of threaded traveling nut 702 at switch housing collar 706. This embodiment would serve to protect the spindles feet end of plunger 268 from damage if the tool were to be accidentally dropped, and to protect damage to the engaged threads of plunger 268 and traveling nut 702 and to protect second switch 710 from possible crushing damage from the traveling nut 702. Wires extending from first and switches 708 and 710; respectively, to second multi-conductor cable 236 are not shown in FIG. 15 for the purposes of clarity. Furthermore, from these teachings, it should be understood that second switch 710 could also be embedded into the cavity sidewall of housing 260 while still being operative by traveling nut 702, thereby simplifying the design.

Figure 16:
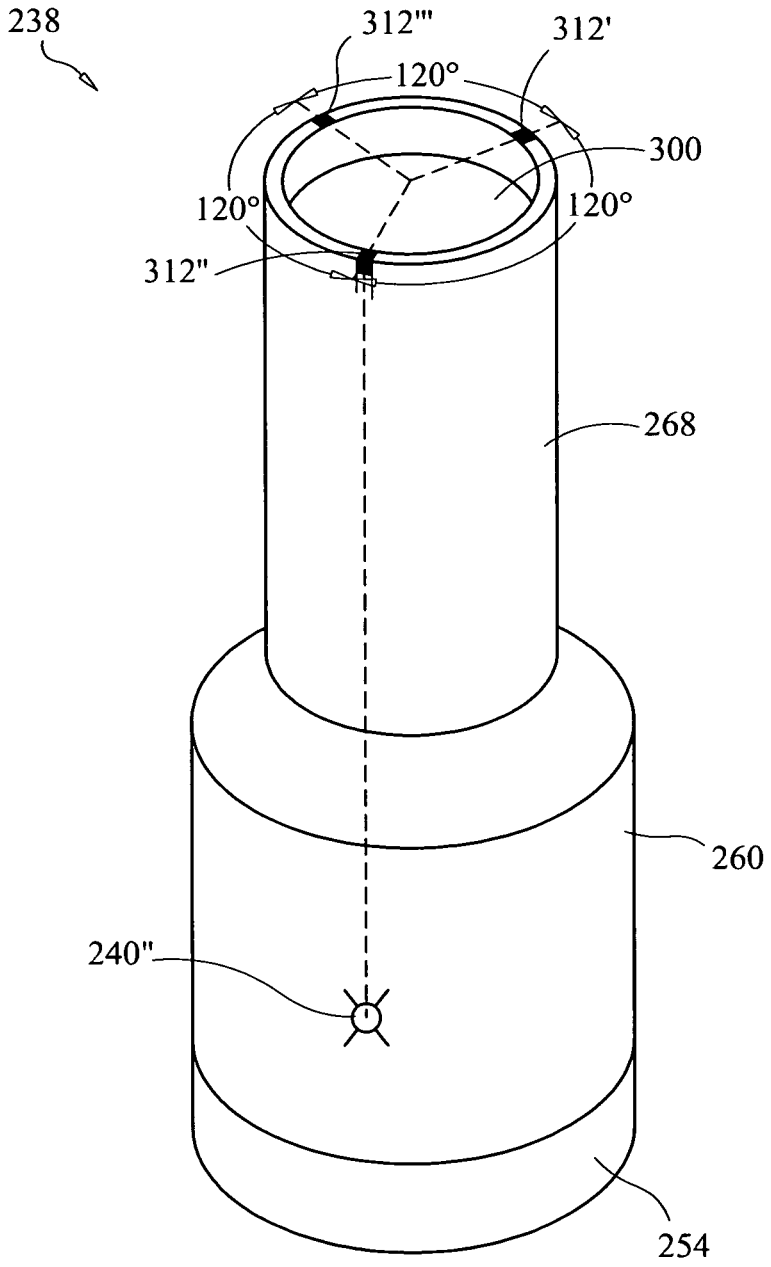
FIG. 16 is a perspective view of still another embodiment of the bucking bar illustrated in FIGS. 7A and 7B and serves to illustrate electrical contact points on the spindles feet.

Referring to FIG. 16, a perspective view of still another alternate embodiment of bucking bar 238 is presented. In this view, spindles feet 312 and anvil face 300 are shown. In this alternate embodiment, electrical conducting contact points (first contact point 312', second contact point 312" and third contact point 312") are located as shown 120-degrees apart.

When bucking bar 238 is oriented orthogonal to second work piece 73, said contact points communicate with second facing surface 76. To ensure positive communicative contact with work, contact points 312', 312" and 312'" may be slightly raised above the spindles feet 312 surface. Each contact point is wired to a second computer (conducting wires and second computer are not shown in FIG. 16 for purposes of clarity). Coupled with computer software, the contact points 312', 312" and 312'" constitute a sensor to detect when spindles feet 312 is in planar contact with second facing surface 76 (i.e., when bucking bar 238 is orthogonal to second facing surface 76).

In a first configuration, operation of the bucking bar embodiment of FIG. 16 is understood by referring back to FIG. 8: When used in bucking bar system 100, each of said contact points is wired to an input channel of a computer on circuit board 212 via multi conductor cable 236. When bucking bar 238 is orthogonally positioned with spindles feet 312 and said contact points resting against second facing surface 76, three additional loop circuits are formed from circuit board 212 through second conducting wire 226, set tool 104, manufactured head 66 and/or first work piece 72 and finally through each of contact points 312', 312" and 312'" and returning to circuit board 212 computer via second multi-conductor cable 236.

In a second configuration, the bucking bar embodiment of FIG. 16 is used in a wireless application. In a wireless application, a second circuit board 212' (not shown) having RF transceiver for communication is located on or near bucking bar 238. Each of contact points 312', 312" and 312'" is each independently wired to its own input channel to the second computer. In this second configuration, the correct orthogonal position of bucking bar 238 is detected by testing continuity loops formed between contact points 312', 312" and 312'" using contact with second facing surface 76 to close the circuit loops. In a first example, continuity is tested between contact points 312' and 312" and then in near-real-time tested between contact points 312" and 312'". This forms a three-point plane test to determine if orthogonal positioning has been achieved. In a second example, power is supplied from the second circuit board to contact point 312' and is detected through the work at contacts 312" and 312'" to determine if orthogonal positioning has been achieved. (Note: This second example may also be used to replace switch 708 in FIG. 15 to detect when the bucker is "ready" since power supplied at any of the contact points 312', 312", or 312'" may be used to form a circuit path by contacting anvil face 300 with rivet shank end 70 via a wire affixed to conducting post 256, for example).

This alternate embodiment may optionally also include three indicating LEDs [first indicating LED (not shown), second indicating LED 240" and third indicating LED (not shown)] similarly located 120-degrees about housing 260 or cap 254. This is illustrated in FIG. 16 by LED 240" located in the same axial plane as second contact point 312". Thus, depending on whether the first or second configuration described above is used, the second computer can identify during the rivet driving stage which contact point(s) are not in communication with second facing surface 76 and illuminate at least one LED to indicate to the bucker a suggested appropriate bucking bar 238 positioning corrective action. For example, if contact points 312' and 312''' are detected but contact point 312'' is not detected, the controller illuminates or flashes second indicating LED 240'' to indicate to the bucker to tip bucking bar 238 towards illuminated second indicating LED 240''. Then, after the bucker has made the appropriate bar 238 positioning correction, the computer stops illumination of second indicating LED 240''. It is understood that the indicating LEDs may also be used to illuminate the work while still serving to indicate bar 238 alignment corrections to the bucker. In such a case, turning the indicating LED lights off or flashing lights may be used to indicate to the bucker a direction of bucking bar 238 correction movement to achieve orthogonal alignment.

A person having ordinary skill in the art would understood that although in the illustrated embodiments three contact points are used to detect tool alignment (in that three-points define a plane), due to the geometry of spindles feet 312, two points may also be used to achieve the same result. Also, more than said three contact points may also be used to achieve the same result.

A person having ordinary skill in the art would also understand that although electrical contact points are illustrated, any contact detection sensor, device or devices, such as a plurality of switches appropriately positioned about the spindles feet 312 could also be used without deviating from the concept of this alternate embodiment. In another example, using these teachings, three or more LVDT sensors may be used to determine alignment of anvil face 300 plane to the work surface plane, allowing the computer to provide LED indication to the bucker to make small corrections to the position of bar 238 to achieve orthogonal alignment or to allow the computer to momentarily disable the rivet gun if bucking bar 238 alignment is outside an acceptable range. LVDT sensors may be incorporated into spindles feet 312 or extend through anvil face 300 as shown in FIG. 9. A person having ordinary skill in the art would also understand that the teaching of this alternate embodiment may be applied to the spindles feet of any embodiment of this invention such as spindles feet 268 shown in FIG. 14.

To summarize FIG. 16, in this embodiment, means are provided for achieving and maintaining parallel planar alignment of anvil face 300 with the work to ensure that rivet shank 68 is driven axially. Additionally, alternate means for detecting when the bucker is "ready" are also provided. Furthermore, means for correcting misalignment of bucking bar 238 via LED light indication during the rivet driving stage are provided or, optionally, the rivet driving stage may be interrupted by momentarily disabling the rivet gun when misalignment is detected.

Figure 17:
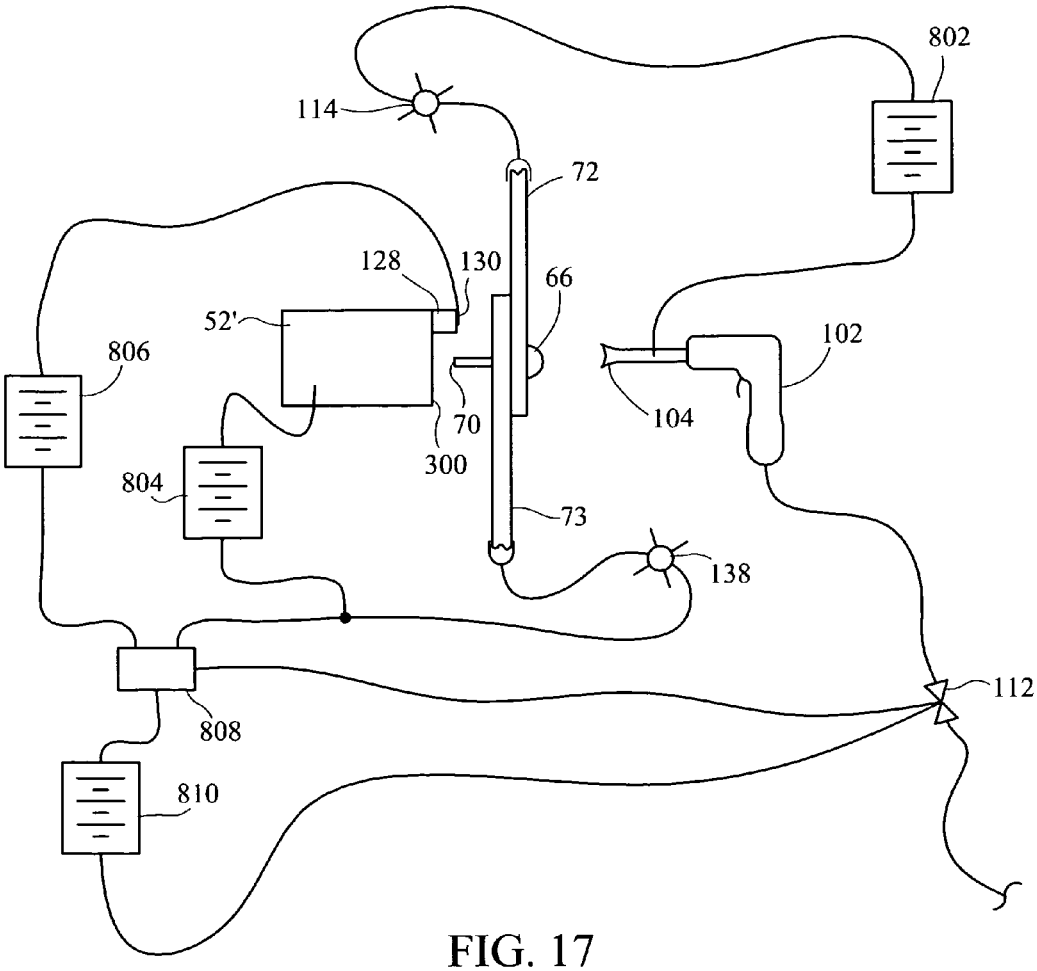
FIG. 17 is a schematic block diagram of yet another simplified embodiment of rivet system illustrated in FIG. 5.

Referring to FIG. 17, a schematic diagram of another relatively simple embodiment of the invention (similar to that shown previously in FIG. 5A) is presented. Although the embodiment illustrated in FIG. 17 is not the most preferred embodiment of the invention, it is used to simplify and teach the invention. In this embodiment, bucking bar system 100 comprises first battery 802 which is coupled to rivet set tool 104 of rivet gun 102. When the rivet gun operator contacts rivet tool 104 against rivet manufactured head 66, a circuit is formed via first LED indicating light 114 (which may also be a work illuminating LED) to indicate to the bucker that the rivet gun operator is ready to start riveting.

Second battery 804 is also coupled to augmented bucking bar 52' at a first end and to second work piece 73 at a second end with fourth LED indicator light 138 disposed inline. When bucker contacts augmented bucking bar 52' against rivet shank end 70, a circuit is formed through second work piece 73, illuminating fourth LED indicator light 138 to indicate to the rivet gun operator that the bucker is ready to start riveting. Seeing fourth LED indicator light 138 illuminate, the rivet gun operator then begins riveting.

Next, similar to the situation described in FIG. 5A, when the desired set rivet head height 84 is obtained, a circuit is formed from battery 806 through contact 130 and work and relay 808, thereby actuating relay 808. When relay 808 is actuated, power from battery 810 is supplied to solenoid valve 112, momentarily disabling the rivet gun power source (air supply). This signals the rivet gun operator to discontinue riveting and both operators then move to then next rivet.

In the embodiment shown in FIG. 17, solenoid valve 112 comprises a two-port valve coupled inline between the air supply and rivet gun 102. In this embodiment, the first valve port is coupled to the air supply and the second valve port is coupled to rivet gun 102. In an alternate embodiment, solenoid valve 112 is a three-port valve likewise coupled between the air supply and rivet gun 102. The first valve port is coupled to the air supply and the second valve port is coupled to rivet gun 102. The third valve port is coupled to the ambient atmosphere. In operation, when rivet gun 102 is energized, the three-port valve allows air to pass from the air supply to rivet gun 102 (from the first port through to the second port) while the third valve port is closed. When rivet gun 102 is de-energized, the three-port valve disconnects the air supply while simultaneously allowing backpressure from rivet gun 102 to be exhausted to the ambient air (from the second port through to the third port). In this embodiment, the three-port valve serves to rapidly de-energize rivet gun 102 by venting backpressure to the atmosphere and to prevent residual rivet gun hammer blows when solenoid valve 112 decouples rivet gun 102 from the air supply.

Figure 18:
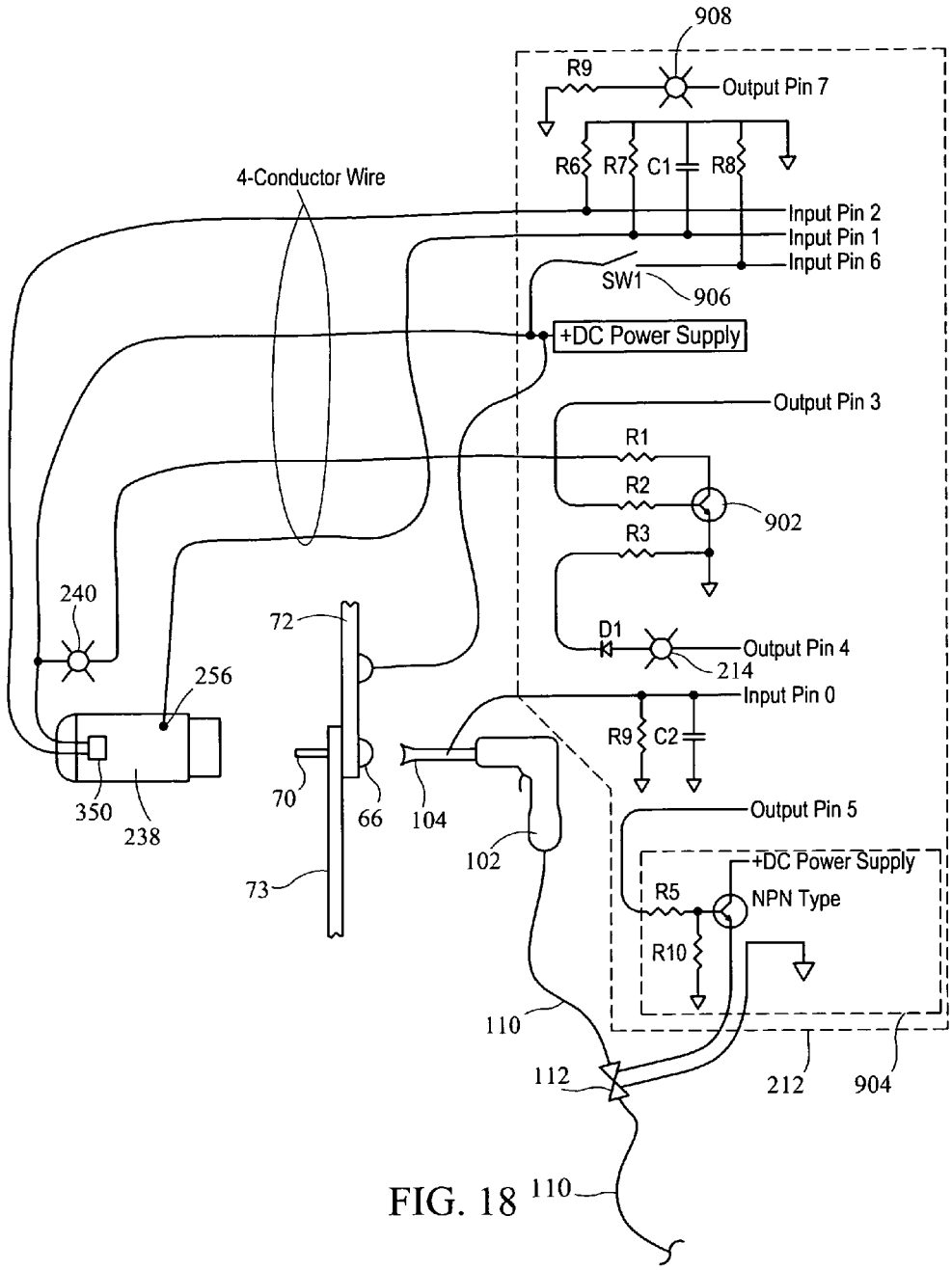
FIG. 18 is a simplified schematic block diagram of yet another simplified embodiment of rivet system.

Referring to FIG. 18, a wiring schematic diagram is presented that is consistent with software instructions in accordance with a preferred embodiment of the invention. These instructions were written and tested using a Basic Stamp 2 microprocessor; in a production embodiment, use of an Atmel tiny micro with programming in the C language is preferred.

In this embodiment, circuit board 212 illustrates in schematic view a preferred wiring diagram for operation of rivet fastening system 100. Circuit board 212 supplies power to the work piece and to bucking bar 238 as shown. This allows contact detection at Input-Pin0 when rivet set tool 104 contacts first work piece 72 or rivet manufactured head 66. Similarly, contact of anvil face 300 (not shown in FIG. 18) of bucking bar 238 with rivet is detected at Input-Pin1. In this schematic configuration switch 350 is Normally Open. Switch 350 actuates when the rivet has been set; this is detected at Input-Pin2.

Further referring to FIG. 18, Output-Pin3 preferably controls the status of bucking bar indicator LED light 240 using a NPN type transistor 902. Output-Pin4 controls the status of mounted LED indicator light 214. Bucking bar indicator LED light 240 and mounted LED indicator light 214 serve to communicate the stage of rivet setting during each rivet setting cycle to bucker and rivet gun operator; respectively. Finally Output-Pin5 is used to control the on or off status of solenoid valve 112 via solenoid driver 904. Any type of solenoid driver 904 may be used: examples include a relay, a Field Effect Transistor, a 555 Integrated Circuit, a NPN or PNP transistor. Also, the solenoid may be driven directly by microprocessor OutputPin5. In this embodiment, the closing of user activated switch 906 is detected at Input-Pin6 to manually place the system into a calibration mode. Additionally, calibration mode LED 908 illuminates when system 100 is in the calibration mode via Output-Pin7 to so inform the users. Other Output Pins (not shown) may be used with other LEDs to direct the user to make clockwise or counterclockwise directional adjustments of positioning jackscrew 252 during calibration.

A person having ordinary skill in the art would understand that there are numerous alternative structural embodiments and alternative computer instructions that could be used to achieve the teaching of this invention. Also, numerous components on circuit 212 have been omitted for purposes of clarity. Furthermore, it is also understood that if rivet fastening non-electrically-conductive work pieces such as plastic or carbon fiber is called for, schematic system 100, as well as its associated computer listing, could be easily modified to maintain operator "ready" indicating status using teachings such as those presented in FIG. 14 (that shows how a switch system may be used to detect when set tool 104 contacts the work piece) as well as those presented in FIG. 15 (that shows how switch 708 may be used to detect when plunger 268 contacts the work piece).

Figure 19:
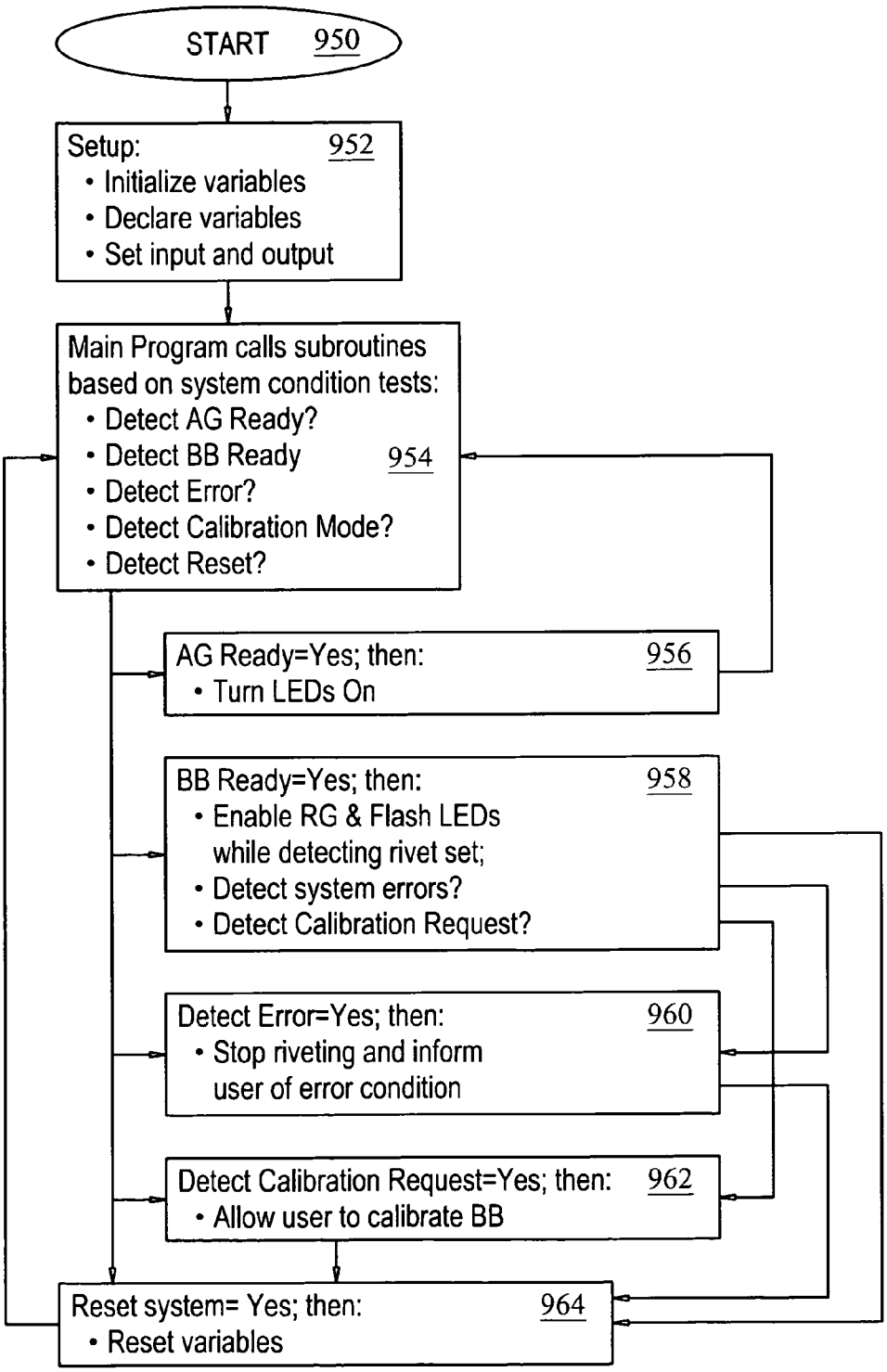
FIG. 19 is schematic flow diagram for software instructions in accordance with a the preferred embodiment of the invention illustrated in FIG. 18.

Referring to FIG. 19, a schematic flow diagram is presented of a more preferred embodiment of software instructions for controller 500. Since the operation of controller 500 governs sequential riveting steps, when system 100 is started at start step 950, it immediately initializes system components in initialize system step 952, by declaring variables, setting variables, inputs and outputs, setting solenoid 112 to disable rivet gun 102, etc.

Next, in main program step 954, system tests are conducted by poling the status of input pins to determine which subroutine to call. Numerous tests are performed. Example tests include detecting whether the rivet gun operator is ready to begin riveting; detecting whether the bucking bar operator is ready to begin bucking; detecting whether there is a sequence or switch fault error (primarily for purposes of forcing the proper sequence of rivet cycle driving stages). Another error test is to detect whether the rivet head height detection sensor is working. Still another test is to determine whether the rivet gun operator has set up on a rivet and then disengaged (removed the rivet gun set tool from the work or rivet head). Still another error test is to determine whether the bucker has removed the bucking bar from the rivet during the rivet driving stage. This is an especially important test since it prevents the air gun operator from riveting against a rivet that is not being backed by the bucking bar; thus preventing damage to the work.

Still further referring to the main program step 954 other tests are conducted. The main program step 954 also detects whether the calibration mode has been requested by the user (by switching system 100 into a calibration mode) or alternately by the system, e.g., requiring bucking bar recalibration after a predetermined number of rivets have been driven. Finally, in main program step 954, the system detects when a system reset is requested by at least one of the users (e.g., by pressing a reset button on circuit board 212) or by the system following the end of a rivet driving cycle, following operation of the error management subroutine, or following operation of the calibration management subroutine.

In rivet gun operator ready step 956, a subroutine is invoked when main program step 954 detects that the rivet gun operator is ready to start riveting. In this first subroutine, the LEDs are turned on to indicate the bucker that the rivet gun operator is ready to begin riveting; the rivet gun operator's LED is also turned on to verify the described communication to the bucker.

In bucker ready step 958, another subroutine is invoked when main program step 954 detects that the bucker is ready to begin bucking. In this second subroutine, rivet gun 102 is enabled and the LEDs are flashed on-and-off to indicate to both operators that the bucker is ready to begin bucking. Meanwhile, in bucker ready step 958, controller 500 continuously monitors for system errors (to be described later) while also continuously monitoring for calibration requests (described earlier). Bucker ready step 958 is where the rivet driving cycle stage is conducted. If no interrupts, such as error faults or calibration requests, are identified in bucker ready step 958, controller 500 disables rivet gun 102 when desired set rivet head height 84 has been achieved and routes logical control to system reset step 964 (described later).

However, still referring to bucker ready step 958, if a system error is detected, rivet gun 102 is disabled and logical control is passed to the error detection block 960. Another possibility is that a calibration request is detected in bucker ready step 958; this would cause rivet gun 102 to be disabled and logical control to be passed to the calibration step 962.

Next, in error detection step 960, a third subroutine is invoked by main program step 954 or by bucker ready step 958 as a result of detecting a system error. There are numerous error possibilities. For example, errors can be a result of a rivet cycle sequencing fault, such as when the bucker attempts to indicate that he is ready to begin bucking before the rivet gun operator has first indicated that he is ready to begin riveting. In another example, if the bucker removes the bucking bar from the rivet during the riveting stage, an error is detected which stops the riveting process to prevent damage to the work resulting from the rivet gun hammering on a rivet that is not backed by the bucking bar. In still another example, an error results if a desired set rivet head height has been detected but the bucker has not indicated that he is ready. These examples illustrate some of the many possible fault detection schemes. After step 960, control is passed to step 964.

Next, in the calibration step 962, a fourth subroutine invoked by main program block 954 or by bucker ready step 958 as a result of detecting a request for system calibration. Calibration step 962 allows the user to identify how many rivets have been driven since the last calibration was performed. This information coupled with total elapsed riveting time can be used by management to help determine worker performance. Additionally, since system 100 tracks the number of rivets driven, it can automatically force a calibration check after a predetermined number of rivets have been set or if the user sets a calibration switch. After step 962, control is passed to step 964.

Finally, system reset step 964 allows test parameters to be cleared or reset before the start of each rivet cycle. The main program step 954, as well as all described subroutines in steps 956, 958, 960 and 962 directly or indirectly invoke system reset block 964; the only exception is the rivet gun ready block 956 which passes control logic to the main program block 954.

In preferred embodiments, system 100 counts the number of rivets driven and invokes an automatic calibration check after setting a predetermined number of rivets. Coupled with measuring total riveting time, the user (or management) is able to assess the rivet setting production performance for a work shift. In preferred embodiments, the number of impacts it takes to set a rivet and/or measuring the rivet setting time is performed by system 100 (this is useful for recommending and/or automatically adjusting air pressure regulator settings to maximize rivet strength by minimizing work hardening of the rivet material). Alternately, assessing the hammer cycle frequency and/or "debounced" bucker contact signals, air pressure regulator settings can also likewise be adjusted.

Figure 20:
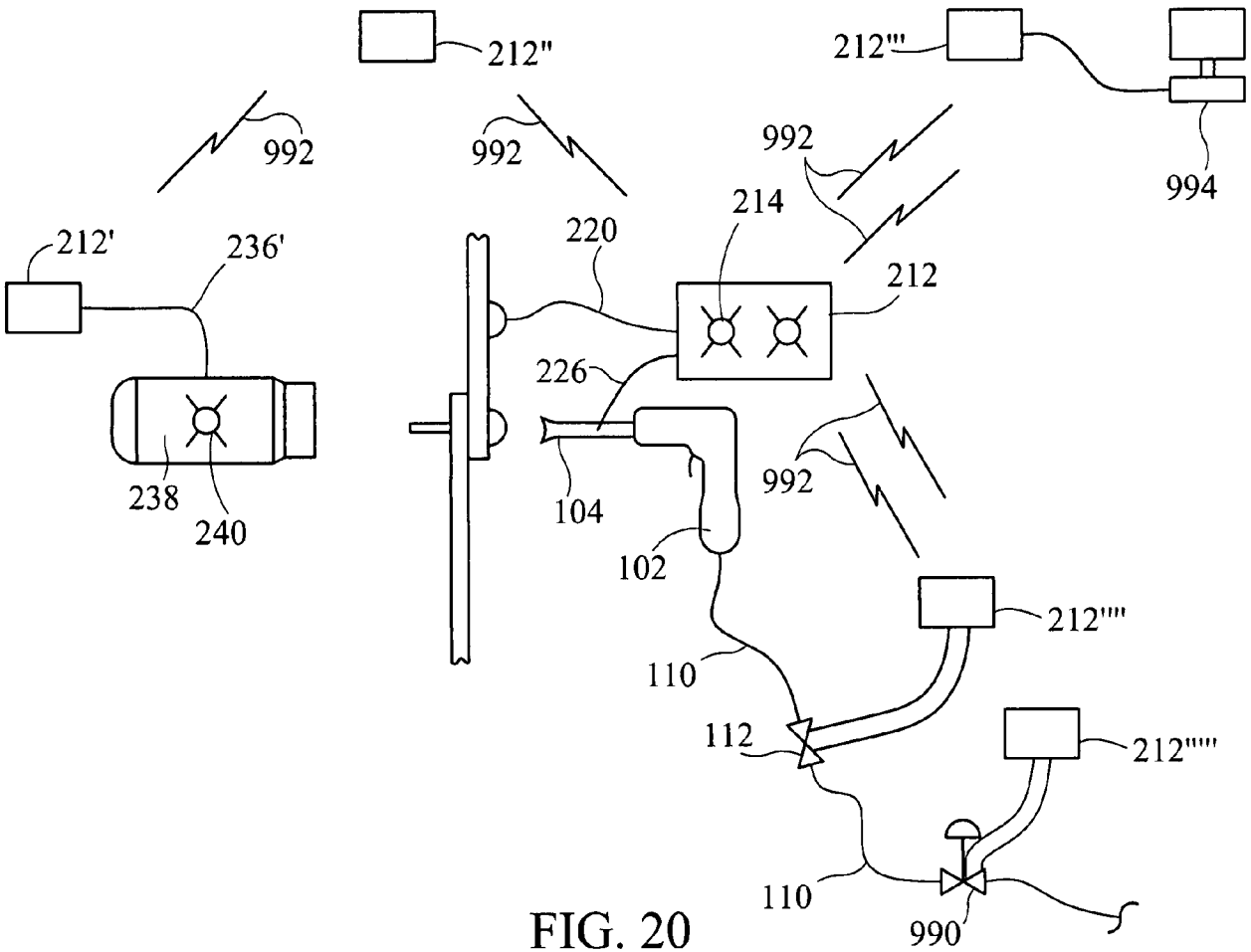
FIG. 20 is a schematic block diagram that illustrates the general relationships among the components of an alternate radio frequency embodiment of the invention.

Referring to FIG. 20, a schematic diagram is presented that depicts relationships among preferred components of circuit boards for a "wireless" i.e. radio frequency (RF) embodiment of the invention. This diagram shows that rivet gun operator control circuit board 212 can communicate directly with second bucker control circuit board 212' using RF signals 992 or alternately communicate using RF signals 992 via a RF repeater circuit board depicted as third circuit board 212". FIG. 20 shows circuit board 212' disposed outside the housing of bucking bar 238; however, circuit board 212' may be incorporated into bucking bar 238.

In preferred embodiments, a RF communication scheme is used to datalog worker progress/productivity; when multiple workers are using these embodiments, the worker's unit must have a RF address. By correlating tool RF addresses, data is preferably transmitted via RF from at least one of circuit board 212, 212', 212", and 212"" to fourth circuit board 212''' which is coupled to a central computer 994 for data logging purposes.

In a preferred embodiment, air solenoid valve 112 is operated by fifth circuit board 212''' having preferably a RF transceiver or at least a RF receiver in communication with at least one of circuit board 212, second circuit board 212' and/or third circuit board 212". Finally, pressure regulator 990 is operated by sixth circuit board 212''' having preferably a RF transceiver or at least a RF receiver to achieve RF communication via 992 signals with at least one of circuit board 212, second circuit board 212' and/or third circuit board 212". In this embodiment, communication between and among all circuit boards is achieved using RF signals 992, although the applicant envisions substituting for RF communication with communication wires (not shown in FIG. 20) for coupling communication between one or more circuit boards.

Finally, referring again to the preferred embodiment shown in FIG. 20, at least one of circuit board 212, 212', and 212" may communicate with the fourth circuit board 212''' which is coupled to a data logging computer 994. All six of the RF circuit boards 212, 212', 212", 212''', 212"", 212""" preferably have transceiver RF capability to allow communication handshaking between each other. It is understood that each circuit board has an RF address to prevent cross-communication with other units of this embodiment. Therefore, data from a plurality of users can be data logged and time stamped at management computer 994 to determine progress, production and rate of work. Furthermore, if the RF address of each riveting tool in this invention is correlated or assigned to a user, user performance and production could be better assessed and managed.

Figure 21A:
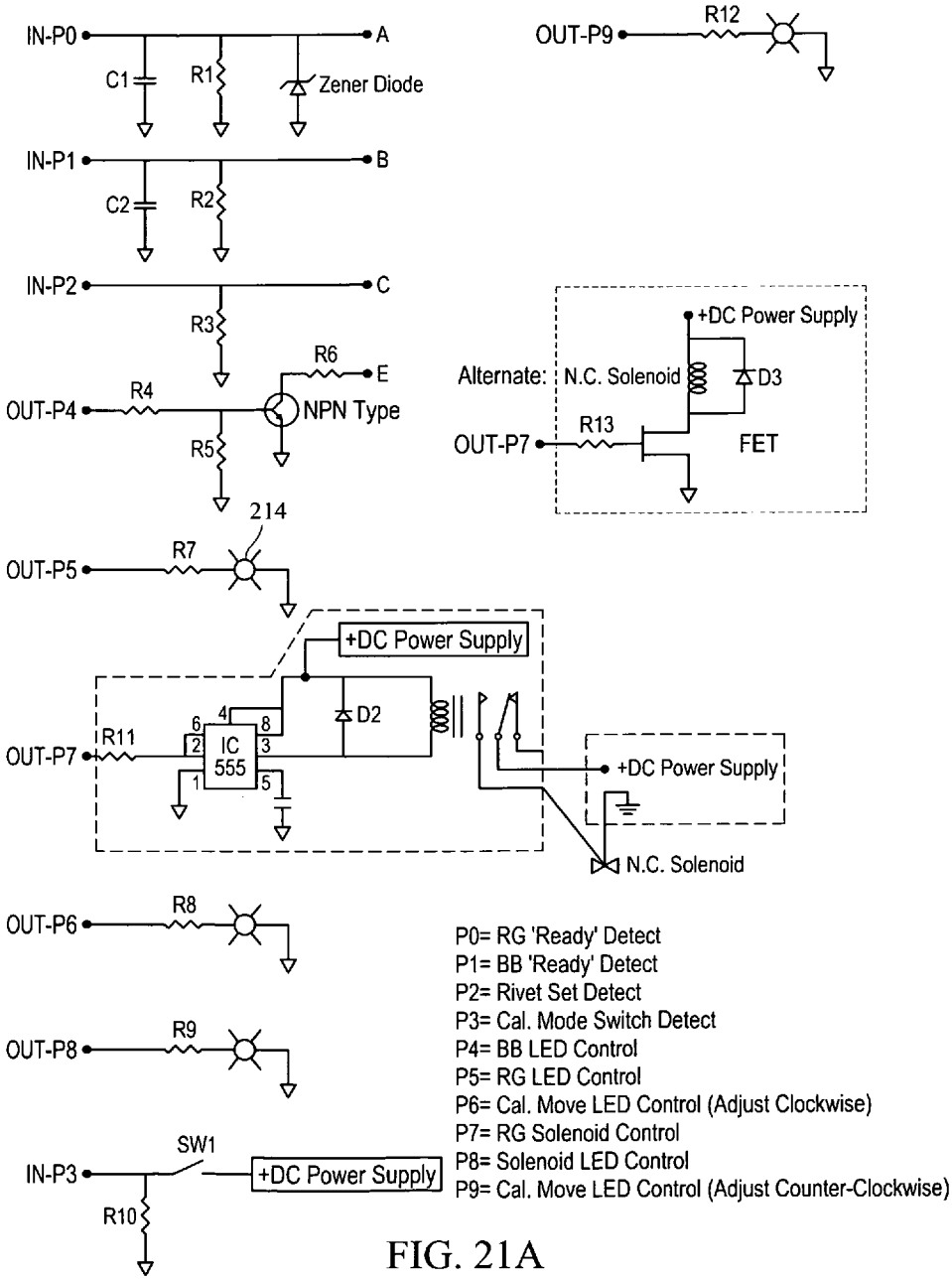
FIGS. 21A and 21B are schematic diagrams that illustrate a preferred embodiment of the invention.
Figure 21B:
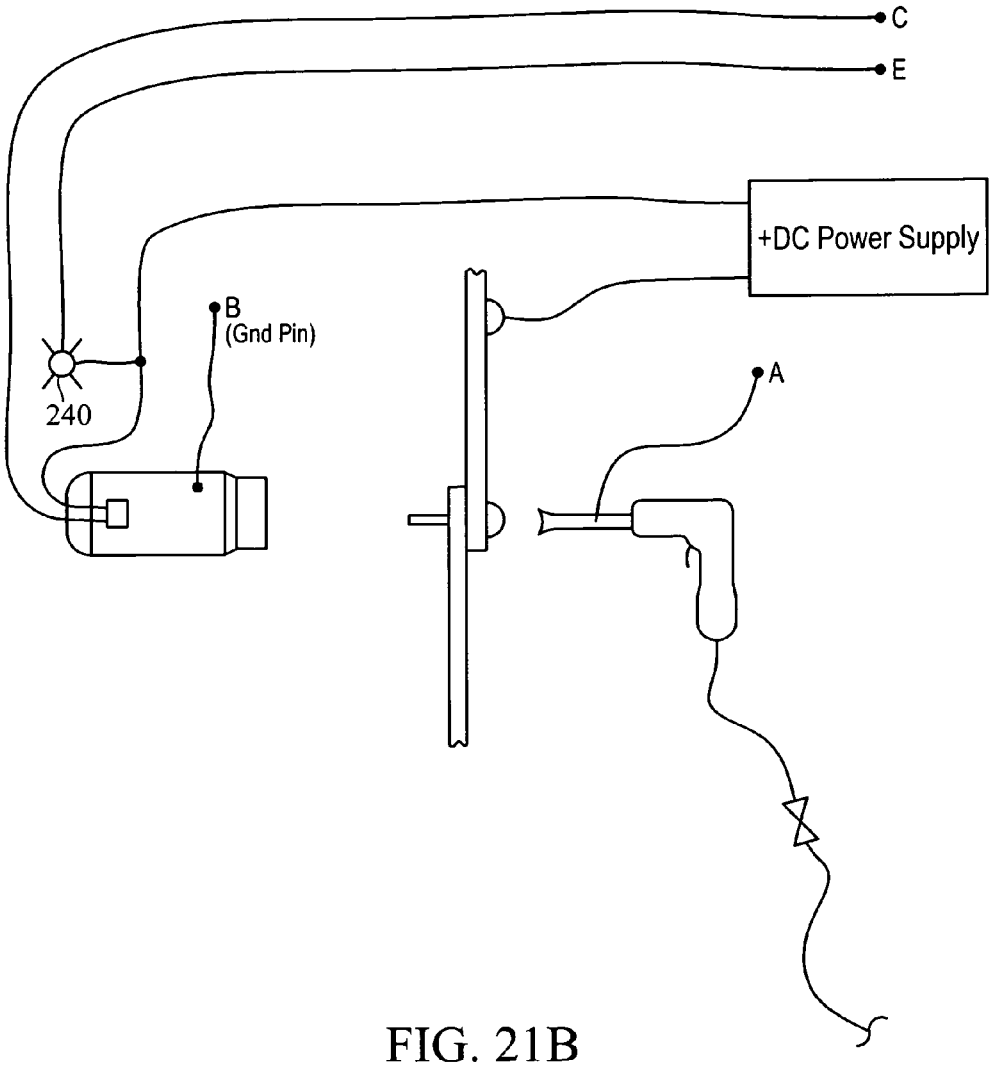

Referring to FIGS. 21A and 21B, more preferred embodiment of the invention is presented. The table shows preferred I/O Pin designations.

In preferred embodiments, the solenoid only enables rivet gun for rivet driving stage; this prevents damage to work. In an alternative embodiment, the rivet gun is "hotwired" to eliminate need for rivet gun operator to use the rivet gun trigger (but, with this embodiment, a user adjustable timing delay prior to starting the rivet gun may be desired for user appeal).

FIG. 21A depicts an alternate solenoid driver using a Field Effect Transistor (FET) which is faster acting that the 555 Integrated circuit. Parallel resistive and capacitive couplings to ground for inputs PIN0 and PIN1 serve to help eliminate false detections and a zener diode coupled to InputPin0 alternately adds additional protection. This arrangement also helps to filter switch chatter (described later).

Working Example

Figure 22:
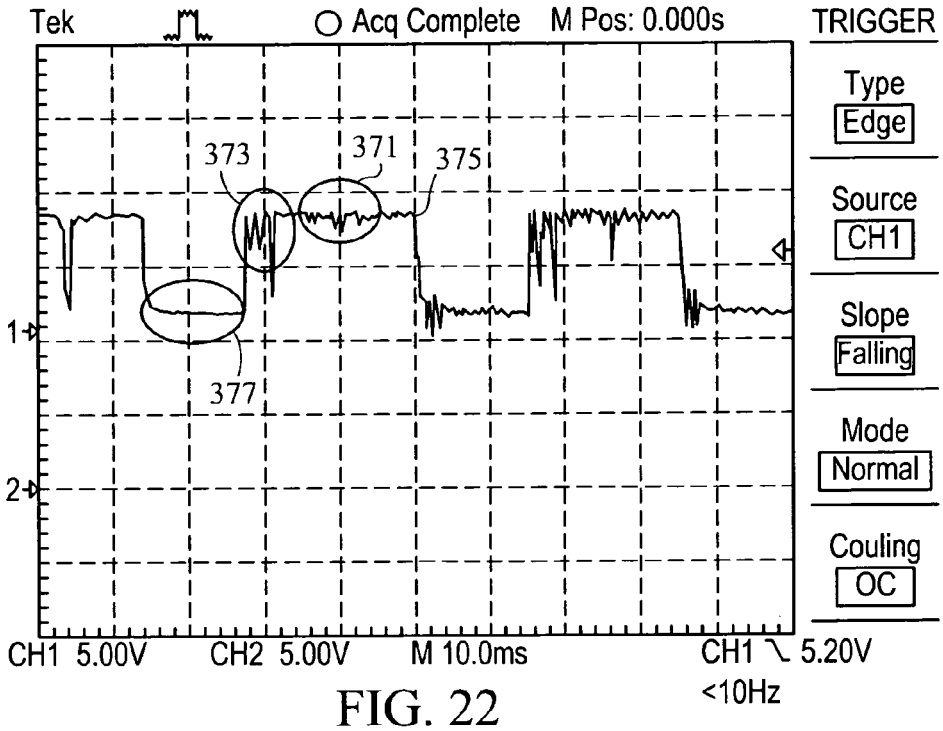
FIGS. 22 and 23 are screen shots of an oscilloscope monitoring the operation of a preferred embodiment of the invention.

Referring to FIG. 22, a digital recording of operation of a prototype of system 100 using an oscilloscope shows bucking bar tool-to-work contact time using a preferred embodiment of bucking bar 238; the drawing represents bar 238 dynamic response to a rivet gun "hammer" cycle. Also, the recording shows clear signs of switch chatter 371 (rapid opening and closing of contacts) indicative of extreme vibration and/or shock between anvil face 300 and rivet shank end 70. Contact bounce or oscillation of movable contact upon closure of circuit was present as indicated by first contact bounce signature 373. The "switch" in this case was the make or break when the bucking bar was in contact or bounced off (not in contact) with the forming rivet head; respectively. When in contact, a voltage was detected and when not in contact, no voltage was detected. The rivet gun "hammer-blow" was indicated by first falling edge hammer signal 375. The time interval the anvil face 300 was "bucked-off" the rivet shank was shown by time interval 377. In general, there was a clear pulse train signature.

Referring to FIG. 22 a rivet gun hammer cycle period was approximately 37 milliseconds (ms) which is equivalent to about 27 Hertz. The time in contact was about 22 ms and the non-contact time was about 15 ms. The regulator air pressure was 90 pounds per square inch. It is important to note that the switch chatter and contact bounce signatures could be an artifact from the oscilloscope, switch (formed by mechanical bouncing of the anvil face against the rivet end) or a combination of these factors; however, signatures variances from oscilloscope measurement would be representatively equivalent in both FIGS. 22 and 23 and, therefore, for comparison purposes, variations from the oscilloscope measurement would be consistent.

Figure 23:
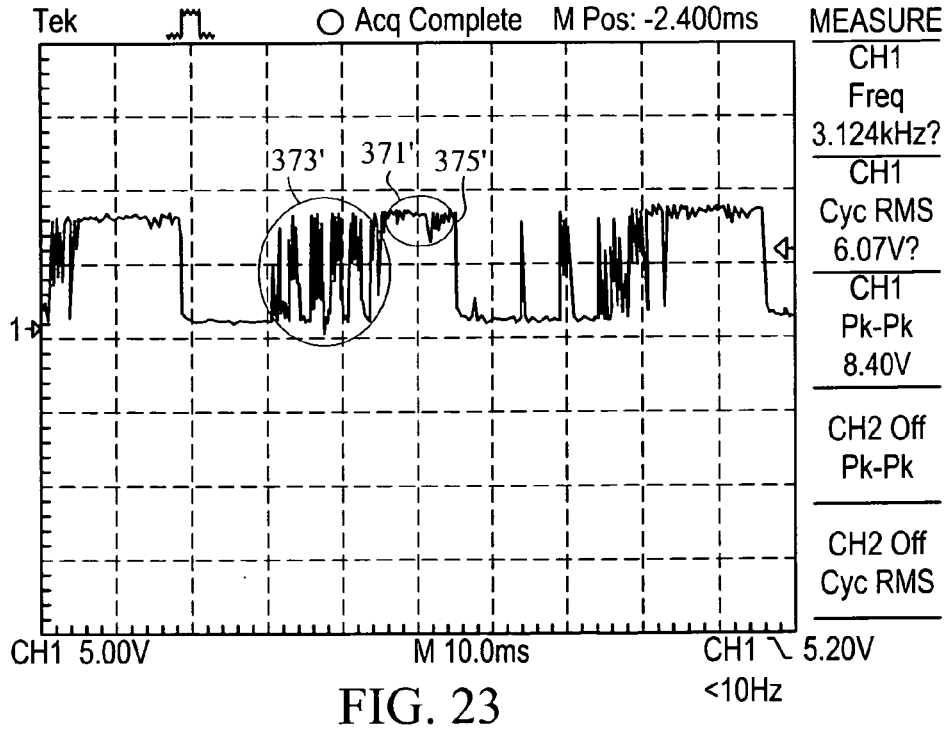

FIG. 23 shows a repeated test using a conventional bucking bar of similar mass. A significant increase in mechanical bouncing (anvil face on rivet head) before coming to rest was present; indicated by the contact bounce signature 373'. Switch chatter 371' was also present along with second falling edge hammer signal 375'. In general, the pulse train exhibited in FIG. 23 was less clearly defined compared to the pulse train in FIG. 22.

In both cases, the anvil face was abutted against the rivet shank end when the rivet gun commenced a "hammer". Careful observation revealed approximately equivalent hammer frequencies. Results are presented in Table 1.

TABLE 1

| Item | Bucking bar 238 | Conventional bucking bar |
|---|---|---|
| Time "in-contact" | 22 ms | 18 ms |
| Time "non-contact" | ~15 ms | 20 ms |
| Mass | 1 lb 10.0 oz | 1 lb 7.2 oz |

The findings of this experiment were that, compared to the conventional bars, bucking bar 238 exhibited a much more well-defined characteristic train-wave signature. The difference between the waveform signatures of FIGS. 22 and 23 is mainly due to the plunger design of bar 238. The high frequency on and off signal in the test of the conventional bucking bar is mainly due to the working pieces resonance from the impulse after the rivet gun fires. The impact of the rivet gun firing causes the working pieces to vibrate at their natural frequencies. Depending on how the work pieces are fixed, their response due to impact could be large and the large displacement vibration could cause the rivet head and the bucking bar to be in intermittent contact (exhibited by 373 and in particular 373'). While using the improved bucking bar 238, the spring-back plunger is preferably always in contact with the working piece, on top of the bucking bar in contact with the rivet head. The additional contact between the plunger and the working piece can limit the working piece vibration after the rivet gun firing through at lease one of three mechanisms: (1) added equivalent dampening of the working piece; (2) changed working piece boundary conditions; and (3) increased working piece equivalent stiffness. The natural frequency of both bucking bars is significantly higher than any waveform signature captured; however careful design of spring plunger system must be practiced to ensure that this system does not have a natural frequency near the rivet gun cycle frequency, which would cause the spring plunger system to resonance.

Consequently, dampening from the compression spring and plunger assembly results in: (1) increased bucking bar stability and consequently controllability (less bouncy), and (2) since bar 238 more quickly returns to an anvil face contacting rivet shank steady-state condition, an ability to increase rivet gun hammer rates, resulting in less work hardening of the rivet material and faster rivet driving. Depending on the rivet gun, increased air pressure settings can result in at least faster hammering frequencies and/or higher hammering amplitudes (such as increased hammer force magnitude). Shorter rivet driving stages could result in a better rivet set result because there is less time for manual tool misalignment motions.

The falling-edge signal occurring immediately after a rivet gun "hammer" appears to be the easiest and most consistent portion of the various waveforms to identify. By using a low pass Butterworth or ChevyChev or other filter, the switch chatter signature 371 and the contact bounce signature 373 could be removed or reduced to produce a "clean" pulse train signature. Hardware or software or a combination of hardware and software filtering are possible. This would allow waveform detection software to be written (or alternately perhaps in combination with edge trigger detection hardware) to identify the hammer blow event of the hammering cycle and determine if the bucker disengaged from the work during a rivet cycle, resulting in an IRQ to stop the gun (reference FIG. 12, step 568).

In the embodiment tested, the solenoid took about 8 milliseconds to disable the rivet gun. Therefore, during a 37 millisecond hammering cycle, an optimized algorithm such as that described in the steps above could prevent an inadvertent hammer blow to the work 8 milliseconds prior to a next second "hammer blow". This provides protection for over 78 percent of a "hammer" period. Thus, by determining the hammer period and identifying the falling-edge-signal, system 100 could determine that anvil face 300 is in contact with rivet shank end 70 just before the rivet gun "hammers" again (or about 10 milliseconds before the next hammer strike). Alternately, another approach to prevent inadvertent hammer blows is to recognize that the rivet gun hammer cycle period is about 37 ms with the in-contact time being about 22 ms; while the solenoid closing speed is about 8 ms. In this approach, the controller simply ensures that there is a sufficient in-contact time interval each hammer cycle.

This example also demonstrated that the bucking bar system described herein could be adapted to work with any conventional bucking bar to roughly set rivets by counting the number of impacts and limiting the driving stage to a specific number of hammer blows. Although rivets would be roughly set due to rivet-setting variables described earlier, this method may be more consistent than previous practices and in particular in cases of highly unique bucking bar shapes are used to buck rivets in difficult to reach locations. These locations are also notoriously difficult to inspect and rework. While this not is not a preferred embodiment of the invention, those skilled in the art, using the teachings herein, could adapt the rivet gun to limit the rivet driving stage to a specific number of hammer blows to set the rivet.

This example also demonstrated that the pulse train signature shown in FIG. 22 can be used to count hammer blows and coupled with a hammer cycle timer also determine hammer frequency. This embodiment allows the setting of the maximum time limit the bucking bar can be decoupled from the rivet during the driving stage. Exceeding this maximum time limit would be a detection of the bucking bar anvil face being disengaged with the rivet during the driving stage and thus prevent inadvertent hammer blows to work not being backed by the bucking bar. In another preferred embodiment, system 100 alternately includes an on-circuit-board accelerometer for determining hammering frequency.

It is understood from these findings that controller 500 may optionally also use measured bucking bar tool-to-work contact data to automatically adjust, or otherwise recommend to the user, the air pressure levels supplied to the rivet gun by adjustment of the air regulator setting. This feedback would effectively modulate the above pulse train signature forming a controlled Pulse Width Modulated (PWM) digital signature i.e.) controlling the elapsed time of the trough and the elapsed time of the crest of the pulse-train signature. It is noted in the described method that a safe time interval prior to a "hammer blow" is important but can also be a limitation to detecting bucking bar disengagement during a riveting stage and to the maximum safe amount of air pressure supplied to the rivet gun.

Furthermore, upon starting a riveting project, users normally practice on test work specimens to ensure they have the proper air pressure regulator setting before beginning work on aircraft surfaces; however, should this step be omitted, controller 500 would optionally also detect anomalies in the measured bucking bar tool-to-work contact signature to identify grossly improper air pressure regulator settings and to immediately stop the rivet gun or alternately adjust to in real time the air pressure regulator thus preventing damage to the work.

Finally to summarize, it is noted that the mechanical vibration and previously cited switch chatter are substantially reduced using bucking bar 238 compared to a conventional bucking bar having similar mass. This reduction in vibration is a result of at least one of the spindles feet contacting the work and/or the compressive spring providing a dampening effect. In either case, preferred embodiments of bucking bar 238 are more stable and controllable when compared to conventional bucking bars of comparable mass. Also, compared to conventional bucking bars of similar mass, bucking bar 238 spends more time with anvil face 300 in communication with the rivet 70. This is a demonstration of the improved performance of preferred embodiments of bucking bar 238 over conventional bars. This improved performance can be exploited by increasing the rivet gun hammer frequency to set rivets faster. Benefits of faster rivet setting include saving time, reducing work hardening of the rivet material resulting is stronger rivets, and improved consistency since critical tool-position holding time is reduced during the rivet driving stage.

A person having ordinary skill in the art would understand that the invention has applications in all types of riveting operations. Applications include aircraft manufacture, recreational trailer manufacturer; commercial semi trailer manufacturer and other riveting operations. Other sensors may be incorporated into system 100, including microstrain miniature contact and non-contact sensors, e.g., available at WWW domain microstrain.com. This invention could be incorporated into other machines without limitation.

Many variations of the invention will occur to those skilled in the art. Some variations include hard wired variations and others call for radio frequency variations. Other variations call for forward riveting and others call for back riveting. All such variations are intended to be within the scope and spirit of the invention.

Although some embodiments are shown to include certain features, the applicant specifically contemplates that any feature disclosed herein may be used together or in combination with any other feature on any embodiment of the invention. It is also contemplated that any feature may be specifically excluded from any embodiment of the invention.

What is claimed is:

1. A tool for forming a rivet head on a rivet shank, said tool comprising:

a housing having a cap portion and having portions defining a cavity extending from the cap;

a plunger that is slidably mounted in said housing cavity;

a hammer attached to said housing, said hammer comprising:

a hammer head slidably engaged within said plunger; and an anvil face formed on the hammer head;

a resilient loading device acting between said housing and said plunger to nominally exert a load on said plunger; and a sensor configured and positioned to sense the position of the anvil face and provide an output signal related thereto.

2. The tool of claim 1, wherein:

said housing having portions defining a cylinder stem that protrudes into the housing cavity; and said plunger having portions comprising a plunger stem that slidably engages with the cylinder stem to assist in aligning said plunger with said housing.

3. The tool of claim 1, wherein said hammer having portions defining a shank stem, said shank stem extending from the hammer head to the cap portion of the housing to fix the hammer head to the housing.

4. The tool of claim 3, wherein the resilient loading device comprising a spring engaged over the hammer shank stem, said hammer shank stem serving as a guide for said spring.

5. A tool for forming a rivet head on a rivet shank, said tool comprising:

a housing having a cap portion and having portions defining a cavity extending from the cap;

a plunger that is slidably mounted in said housing cavity, said plunger having portions defining a shroud;

a hammer attached to said housing, said hammer comprising:

a hammer head slidably engaged within said plunger shroud; and an anvil face formed on the hammer head;

a resilient loading device acting between said housing and said plunger to nominally exert a load on said plunger; and a first sensor disposed within said housing cavity to sense the position of the anvil face, said first sensor being operative to change its state when the position of the anvil face indicates that a desired set rivet head height has been achieved.

6. The tool of claim 5, wherein the first sensor senses the position of the plunger relative to the housing.

7. The tool of claim 5, wherein the first sensor senses the position of the plunger relative to the anvil face.

8. The tool of claim 5, wherein the first sensor is adjustable to selectively change a desired rivet head height.

9. The tool of claim 5, further comprising:

a conducting post that is attached to said cap and disposed in said cavity, said conducting post being in electrical communication with said anvil face;

a first electrical conductor that is in electrical communication with a work piece and that is operative to form a conducting path from said work piece through the rivet and said anvil face to said conducting post, thereby providing a second sensor that is operative to sense when said anvil face is in contact with the rivet;

a bucking bar visual indicator that is attached to the housing;

a second electrical conductor that connects a computer to said conducting post to provide means for determining the state of said second sensor and detecting when said anvil face is in contact with the rivet or detecting when said anvil face is not in contact with the rivet;

a third conductor that connects said bucking bar visual indicator to a ground and to a power source, to computer control said bucking bar visual indicator to effectuate means for communicating a driving stage to a user; and wherein said bucking bar visual indicator is operative in a first fashion when a rivet gun operator is ready to commence riveting and in a second fashion when a rivet gun operator and a bucking bar operator are both ready to commence riveting.

10. A tool for forming a rivet head on a rivet shank, said tool comprising:

a housing having a cap portion and having portions defining a cavity extending from the cap;

a plunger that is slidably mounted in said housing cavity, said plunger having portions defining a shroud;

a hammer attached to said housing, said hammer comprising:

a hammer head slidably engaged within said plunger shroud; and an anvil face formed on the hammer head;

a resilient loading device acting between said housing and said plunger to nominally exert a load on said plunger; and wherein said plunger further comprises a spindles feet that is disposed around said hammer and beyond said anvil face.

11. A tool for forming a rivet head on a rivet shank, said tool comprising:

a housing having a cap portion and having portions defining a cavity extending from the cap;

a plunger that is slidably mounted in said housing cavity, said plunger having portions defining a shroud;

a hammer attached to said housing, said hammer comprising:

a hammer head slidably engaged within said plunger shroud; and an anvil face formed on the hammer head;

a resilient loading device acting between said housing and said plunger to nominally exert a load on said plunger; and a plurality of electrical conducting contact points disposed around said plunger shroud; and an electrical conductor connecting each of said electrical conducting contact points to a computer that is operative to detect which of said conducting contact points are resting on a work piece.

12. A tool for forming a rivet head on a rivet shank, said tool comprising:

a housing having a cap portion and having portions defining a cavity extending from the cap;

a plunger that is slidably mounted in said housing cavity, said plunger having portions defining a shroud;

a hammer attached to said housing, said hammer comprising:

a hammer head slidably engaged within said plunger shroud; and an anvil face formed on the hammer head;

a resilient loading device acting between said housing and said plunger to nominally exert a load on said plunger;

a computer; and a plurality of visual indicators disposed around said shroud, any number of said visual indicators being operative if directed to do so by said computer.

13. A tool in the form of a bucking bar tool or a rivet gun set tool, for use with a rivet gun in forming a rivet head on a rivet shank end by deforming the rivet shank, said tool comprising:

a hammer having an anvil face;

a plunger comprising:

portions for slidably engaging said hammer; and a spindles feet, said spindles feet extending beyond said anvil face;

a loading member that is operative to nominally urge said spindles feet beyond said anvil face;

a first sensor that is operative to measure a first distance or a gap height between said anvil face and said spindles feet; and a controller that is operative to couple or decouple the rivet gun from a power supply, thereby enabling or disabling the rivet gun.

14. The tool of claim 13, wherein said controller is operative to disable said rivet gun when said first distance or gap height substantially matches a desired rivet head height.

15. The tool of claim 13, further comprising a second sensor that is operative to sense when said anvil face contacts either a rivet manufactured head or the rivet shank end.

16. The tool of claim 15, further comprising an indicator that is operative to indicate to a user when said second sensor senses said contact, said indicator being under the control of said controller.

17. The tool of claim 15, wherein said controller is operative to disable the rivet gun when said anvil face is disengaged from the shank end during a rivet driving stage.

18. A tool in the form of a bucking bar tool or a rivet gun set tool for setting a rivet, the rivet having a manufactured head and a shank having a shank end, said tool comprising:

a hammer having an anvil face;

a second sensor that is operative to sense when said anvil face makes a contact with either the manufactured head or the shank end;

an indicator that is operative indicate when said second sensor senses said contact; and a controller that operative to actuate said indicator, thereby informing a user when said anvil face makes said contact.

19. The tool of claim 18, wherein:

said indicator comprises a first visual indicator; and said controller is operative to actuate said first visual indicator when said bucking bar tool contacts either the manufactured head or the shank end.

20. The tool of claim 18, wherein:

said indicator comprises a second visual indicator; and said controller actuates said second visual indicator when said rivet gun set tool contacts either the manufactured head or the shank end.

21. A tool for forming a rivet head on a rivet shank for attaching a plurality of members together, said tool comprising a distal end for contacting the rivet shank and a proximal end opposite the distal end, and comprising:

a manually graspable and supportable housing having a cap portion at the proximal end of the tool and having portions defining a cavity extending from the cap toward the distal end of the tool;

a plunger that is slidably mounted in said housing cavity for movement relative to the housing cavity lengthwise of the plunger, said plunger having portions defining a shroud having an open distal end, the distal end of the shroud configured to be bearable against at least one of the members being fastened together to position and orientate the tool relative to the at least one member;

a hammer fixedly attached to said housing and extending through the plunger, said hammer comprising:

a hammer head slidably engaged within said plunger shroud; and an anvil face formed on the hammer head for striking the rivet shank; and a resilient loading device acting between said housing and said plunger to nominally exert a load on said plunger.

* * * * *